US008848968B1

(12) United States Patent
James, Jr. et al.

(10) Patent No.: US 8,848,968 B1
(45) Date of Patent: Sep. 30, 2014

(54) MECHANICALLY ADJUSTABLE VARIABLE FLUX SPEAKER

(75) Inventors: Thomas A. James, Jr., Bethlehem, KY (US); Kevin E. Parrish, LaGrange, KY (US); William L. Watts, Crestwood, KY (US)

(73) Assignee: Eminence Speaker, LLC, Eminence, KY (US)

( * ) Notice: Subject to any disclaimer, the term of this patent is extended or adjusted under 35 U.S.C. 154(b) by 0 days.

(21) Appl. No.: 13/584,037

(22) Filed: Aug. 13, 2012

Related U.S. Application Data

(63) Continuation of application No. 12/686,958, filed on Jan. 13, 2010, now Pat. No. 8,249,292.

(51) Int. Cl.
*H04R 25/00* (2006.01)

(52) U.S. Cl.
USPC ..... 381/422; 381/412; 381/414

(58) Field of Classification Search
USPC ..... 381/422, 412, 414, 396, 124, 189, 421
See application file for complete search history.

(56) References Cited

U.S. PATENT DOCUMENTS

| | | | | |
|---|---|---|---|---|
| 2,030,574 | A | 2/1936 | Dull | |
| 3,213,181 | A | 10/1965 | Snoddy et al. | |
| 4,711,149 | A | 12/1987 | Starr | |
| 5,151,943 | A * | 9/1992 | Van Gelder | 381/189 |
| 5,233,123 | A | 8/1993 | Rose et al. | |
| 5,487,114 | A | 1/1996 | Dinh | |
| 5,723,805 | A | 3/1998 | Lacombe | |
| 5,761,316 | A | 6/1998 | Pritchard | |
| 5,761,317 | A | 6/1998 | Pritchard | |
| 6,216,059 | B1 | 4/2001 | Ierymenko | |
| 6,243,479 | B1 | 6/2001 | Proni | |
| 6,574,346 | B1 * | 6/2003 | Tanaka | 381/421 |
| 6,639,994 | B1 | 10/2003 | Proni et al. | |
| 6,738,490 | B2 * | 5/2004 | Brandt | 381/421 |
| 6,778,677 | B2 * | 8/2004 | Coffin | 381/418 |
| 6,792,120 | B1 | 9/2004 | Szenics | |
| 7,065,225 | B2 | 6/2006 | Stiles | |
| 7,548,627 | B2 | 6/2009 | Takase et al. | |

(Continued)

FOREIGN PATENT DOCUMENTS

| | | |
|---|---|---|
| GB | 2253509 | 9/1992 |
| GB | 414352 | 10/2004 |

(Continued)

OTHER PUBLICATIONS

Carlisi et al., "An Alternative Approach to Minimize Inductance and Related Distortions in Loudspeakers", J. Audio Eng. Soc. AES 118th Convention Paper, May 28-31, 2005 E.

(Continued)

*Primary Examiner* — Duc Nguyen
*Assistant Examiner* — Phan Le
(74) *Attorney, Agent, or Firm* — Middleton Reutlinger; Robert H. Eichenberger; Scott W. Higdon

(57) ABSTRACT

The present disclosure is directed to inventive methods and apparatus for a variable flux speaker subassembly for a loudspeaker. The variable flux speaker subassembly may contain at least one repositionable structure that is repositionable from at least a first position to a second position. The magnetic flux through a voice coil structure of the speaker subassembly is altered when the repositionable structure is moved from the first position to the second position.

20 Claims, 24 Drawing Sheets

(56) References Cited

U.S. PATENT DOCUMENTS

| | | | | |
|---|---|---|---|---|
| 2002/0048379 | A1 | 4/2002 | Flentje | |
| 2003/0031338 | A1* | 2/2003 | Suzuki et al. | 381/398 |
| 2004/0212254 | A1* | 10/2004 | Stiles | 310/12 |
| 2006/0222199 | A1 | 10/2006 | Abe et al. | |
| 2008/0025551 | A1 | 1/2008 | Wehner | |
| 2008/0101629 | A1 | 5/2008 | Carey | |

FOREIGN PATENT DOCUMENTS

| | | |
|---|---|---|
| JP | 62213397 | 9/1987 |
| JP | 1022200 | 1/1989 |
| JP | 10322790 | 12/1998 |
| JP | 2005208659 | 8/2005 |
| WO | 98047132 | 10/1998 |

OTHER PUBLICATIONS

La Haute Fidelitelntegrale; 400-2000 EXC; http://www.supravox.fr/anglais/haut.sub.--parleurs/400.sub.--2000.sub.--E-XC.htm E.

Audiokarma; http://www.audiokarma.org/forums/archive/index.php/t-90189.html.

La Haute Fidelitelntegrale; 165-2000 EXC; http://www.supravox.fr/anglais/haut.sub.--parleurs/165.sub.--Exc.htm.

ICC Technology; Mytho Reference Monitors; http://www.rcf.it/products/recording/mytho-reference-monitors/icc-technol-ogy.

Leach, Jr., "Loudspeaker Voice-Coil Inductance Losses: Circuit Models, Parameter Estimation, and Effect on Frequency Response", J. Audio Eng. Soc. vol. 50, No. 6, Jun. 2002.

Ponteggia et al., "Electrical Circuit Model for a Loudspeaker With an Additional Fixed Coil in the Gap", J. Audio Eng. Soc. Aes 128th Convention Paper, May 22-25, 2010; London, UK.

J. D. Seabert, "Electrodynamic Speaker Design Considerations", Proceedings of the IRE, vol. 22, No. 6, Jun. 1934, pp. 738-750.

Olson, Harry F; Acoustical Engineering, Third Edition, 1957, pp. 176-183 and 196-205; NJ, USA.

Gander; "Dynamic Linearity and Power Compression in Moving-Coil Loudspeakers", J. Audio Eng. Soc. vol. 34, No. 9, Sep. 1986.

Button; "Magnetic Circuit Design Methodologies for Dual-Coil Transducers", J. Audio. Eng. Soc. vol. 50, No. 6, Jun. 2002.

Griffin et al., "The Application of Smart Structures Toward Feedback Suppression to Amplified Acoustic Guitars", J. Acoust. Soc. Am. 113(6), Jun. 2003.

Marshall et al., "Vibrotactile Feeback in Digital Musical Instruments", NIME, Jun. 4-8, 2006.

Infinity; Car Audio and Electronics—Kappa Perfect 12d VQ Subwoofer; http://www.infinitysystems.com/car/products/10946.sub.--eprint.pdf; Nov. 2003.

Gip Laboratory; Global Intelligence Planning Accoustic Laboratory Division; http://www.gip-laboratory.com/; 2005.

* cited by examiner

| LOCATION | 0 | 0.125 | 0.25 | 0.312 |
|---|---|---|---|---|
| B(kG) | 9.80943 | 5.96673 | 4.329522 | 3.5824 |
| % CHANGE | | -39.17 | -55.86 | -63.48 |
| SPL | 96.00 | 91.68 | 88.90 | 87.25 |
| SPL DROP | | 4.32 | 7.10 | 8.75 |
| Qes | 1.40 | 3.78 | 7.19 | 10.50 |

FIG. 3B

MECHANICALLY ADJUSTABLE VARIABLE FLUX SPEAKER

CROSS-REFERENCE TO RELATED APPLICATIONS

This application is a continuation of U.S. patent application Ser. No. 12/686,958, filed Jan. 13, 2010 and entitled "Mechanically Adjustable Variable Flux Speaker."

TECHNICAL FIELD

The present invention is directed generally to a speaker subassembly for a speaker. More particularly, various inventive methods and apparatus disclosed herein relate to a variable flux speaker subassembly for a loudspeaker.

BACKGROUND

Loudspeakers generally include a frame, a speaker subassembly, a diaphragm/cone, a lower suspension/spider, and a surround. In some speakers the speaker subassembly includes a permanent magnet mounted between a top plate and a back plate, a pole piece centrally mounted on the back plate and a voice coil structure axially movable with respect to the pole piece. One end of the cone is connected to the surround or upper suspension, which is mounted to the upper end of the frame. The lower suspension or spider is connected at one end to a seat formed in the frame at a point between its upper and lower ends. The free ends of the diaphragm and spider are mounted to the voice coil structure and support it within the air gap between the pole piece and top plate of the speaker subassembly, with the voice coil structure concentrically disposed about the pole piece. Optionally, a dust cap may be mounted to the cone to overlie the voice coil structure and pole piece to protect them from contaminants. In the course of operation of a speaker of the type described above, electrical energy is supplied to the voice coil structure causing it to axially move relative to the pole piece and within the air gap formed between the top plate and pole piece. The diaphragm, spider, and surround move with the excursion of the voice coil structure.

SUMMARY

The present disclosure is directed to a speaker subassembly for a speaker, and, more particularly, various inventive methods and apparatus disclosed herein relate to a variable flux speaker subassembly for a loudspeaker. The variable flux speaker subassembly may contain at least one repositionable structure such as, for example, at least one repositionable ferrous and/or magnetic structure that is repositionable from at least a first position to a second position. The magnetic flux through a voice coil structure of the speaker subassembly is altered when the repositionable structure is repositioned from the first position to the second position. For example, in some embodiments the at least one repositionable structure may include a pole piece located interiorly of a magnet and the voice coil structure. The pole piece may be repositionable between a first and second position along a longitudinal axis thereof.

Generally, in one aspect, a speaker subassembly for a speaker comprises a top plate, a magnet structure, a pole piece, and a voice coil structure. The top plate has a top plate opening therethrough. The pole piece is positioned interiorly of the top plate and has an upper end, a lower end, and a longitudinal axis extending in a direction from the upper end to the lower end. The magnet structure is in magnetic communication with the top plate and the pole piece. The voice coil is substantially concentrically disposed about the pole piece and interposed between the pole piece and the top plate. The voice coil structure has a voice coil magnetic flux therethrough. The pole piece is repositionable along the longitudinal axis from at least a first position to a second position. In the first position of the pole piece the voice coil magnetic flux is greater than in the second position of the pole piece.

In some embodiments the pole piece is at least partially surrounded by a non-ferrous guide sleeve. In some versions of these embodiments the guide sleeve is surrounded by a fixedly positioned ferrous core sleeve.

In some embodiments the pole piece may be coupled to a shaft extending substantially parallel to the longitudinal axis. In some versions of those embodiments the shaft may extend through an opening in the back plate. Optionally, at least a portion of the shaft may be threaded. In some versions of those embodiments the shaft may be coupled to an adjustment knob. In some versions of those embodiments at least a portion of the adjustment knob may be threaded.

Generally, in another aspect, a speaker subassembly for a speaker comprises a top plate, a back plate, a magnet structure, a pole piece, and a voice coil. The top plate has a top plate opening therethrough. The back plate is spaced from the top plate. The magnet structure is interposed between the top plate and the back plate and surrounds and defines a magnet opening. The magnet opening is accessible through the top plate opening. The magnet structure may optionally be a permanent magnet structure. The pole piece is positioned interiorly of the top plate and the magnet and has an upper end, a lower end more proximal the back plate than the upper end, and a longitudinal axis extending from the upper end to the lower end. A non-ferrous guide structure surrounds and is coupled to at least a portion of the pole piece. A fixedly positioned ferrous core sleeve telescopically receives the non-ferrous guide structure. The voice coil structure is substantially concentrically disposed about the pole piece. The pole piece is repositionable along the longitudinal axis from at least a first position to a second position. In the first position the lower end of the pole piece is more proximal the back plate than it is in the second position.

In some embodiments the guide structure is a guide sleeve. In some versions of those embodiments the guide sleeve has an overhang proximal the upper end thereof and the guide sleeve extends from the lower end of the pole piece to the overhang of the pole piece. In some versions of those embodiments the core sleeve extends from the lower end of the pole piece to the overhang of the pole piece.

In some embodiments the pole piece is coupled to a shaft extending substantially parallel to the longitudinal axis. In some versions of those embodiments the shaft extends through an opening in the back plate. Optionally, at least a portion of the shaft may be threaded. In some versions of those embodiments the shaft is coupled to an adjustment knob. In some versions of those embodiments at least a portion of the adjustment knob is threaded. In some versions of these embodiments at least a portion of the outer periphery of the adjustment knob is threaded and engages an interiorly threaded extension extending from the back plate.

Generally, in another aspect, a method of selectively adjusting magnetic flux through a voice coil structure of a loudspeaker comprises repositioning a structure of the loudspeaker such as, for example, a ferrous structure. The ferrous structure may be in magnetic communication with a first pole of a magnet of the loudspeaker and a second pole of the magnet. The ferrous structure has a magnetic flux therethrough. The ferrous structure is repositionable from at least a first position to a second position. The magnetic flux through the voice coil structure is greater in the first position of the ferrous structure than in the second position of the ferrous structure.

In some embodiments the ferrous structure is a pole piece positioned interiorly of a top plate of the loudspeaker, the pole piece having an upper end, a lower end, and a longitudinal axis extending from the upper end to the lower end. The pole piece is repositionable along the longitudinal axis. In some versions of these embodiments the pole piece is coupled to a shaft extending substantially parallel to the longitudinal axis.

Generally, in another aspect, a speaker subassembly for a speaker comprises a top plate, a back plate, a magnet structure, a pole piece, and a voice coil. The top plate has a top plate opening therethrough. The back plate is spaced from the top plate. The magnet structure is interposed between the top plate and the back plate. The pole piece is positioned interiorly of the top plate has an upper end, a lower end more proximal the back plate than the upper end, and a longitudinal axis extending from the upper end to the lower end. A voice coil structure is substantially concentrically disposed about the pole piece and has an adjustable magnetic flux therethrough. At least one ferrous structure is in magnetic communication with the top plate and the back plate and repositionable from at least a first position to a second position. The magnetic flux through the voice coil structure is greater in the first position of the ferrous structure than in the second position of the ferrous structure.

In some embodiments the ferrous structure is positioned between the top plate and the bottom plate.

In some embodiments the ferrous structure is positioned between the pole piece and the magnet. In some versions of those embodiments the ferrous structure comprises at least one rod extending through the back plate. In some versions of those embodiments the rod is substantially parallel with the longitudinal axis of the pole piece. In some versions of those embodiments the rod threadedly engages the back plate.

In some embodiments a plurality of the ferrous structure are provided. In some versions of those embodiments a plurality of openings are provided through the back plate, each opening being configured for receipt of at least one of the ferrous structure. In some versions of those embodiments at least one of the ferrous structure is selectively removably received in one of the openings.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

FIG. 3B illustrates a table showing various characteristics of the first embodiment of the speaker when the pole piece is in the first position, second position, third position, and fourth position.

DETAILED DESCRIPTION

Figure 1A:
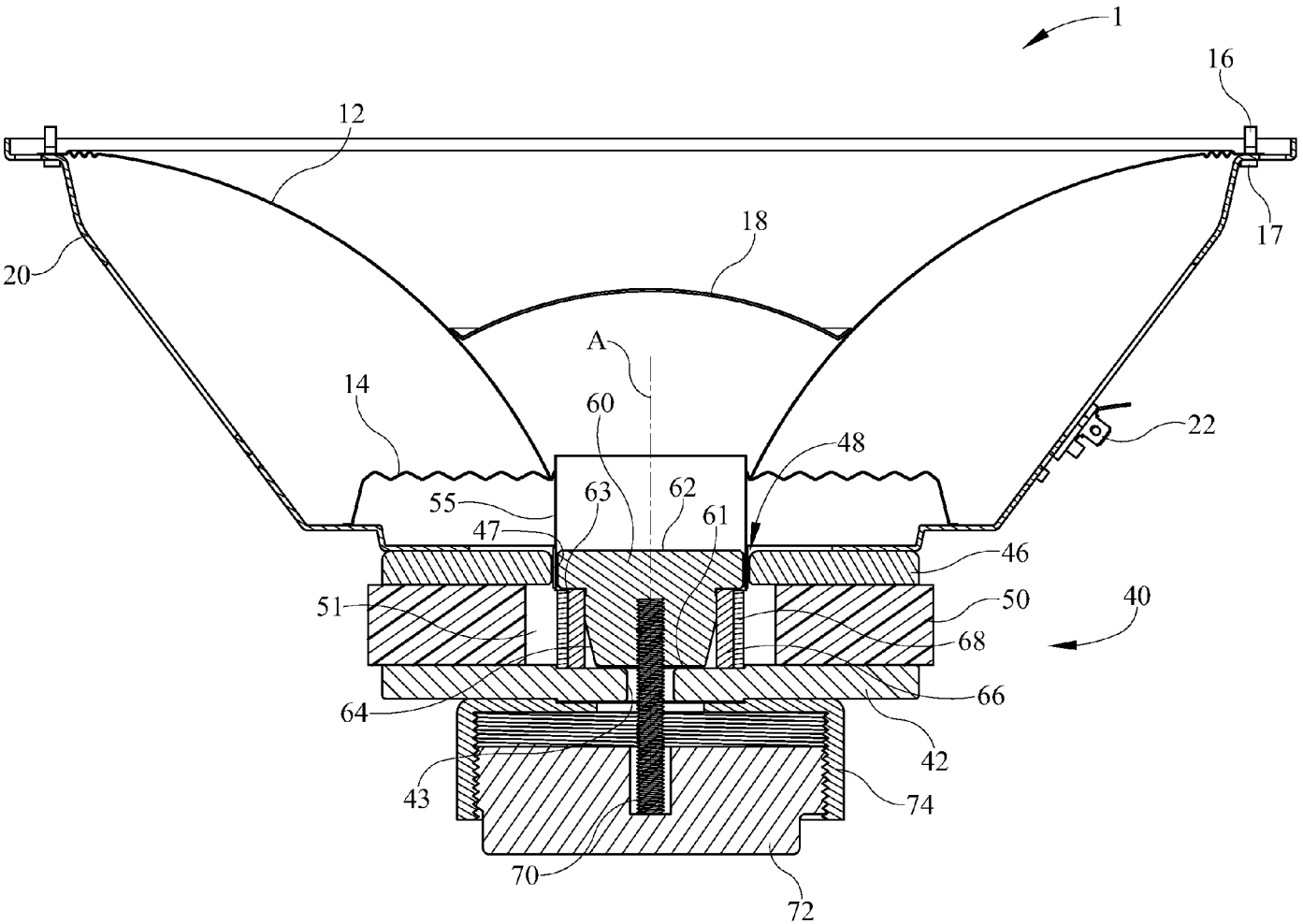
FIG. 1A illustrates a first embodiment of a variable flux speaker with a pole piece of a speaker subassembly of the speaker in a first position.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. For example, various embodiments of the speaker subassembly for a speaker disclosed herein are described in conjunction with other speaker components such as, for example, a cone, frame, spider, front gasket, and dust cap. However, one ordinary skill in the art, having had the benefit of the present disclosure will recognize and appreciate that the speaker subassembly may be implemented in speakers having alternative speaker components and/or alternative configurations of the speaker components described herein. For example, the speaker subassembly may be implemented in speakers having a cone with an alternative topology and/or having an alternative suspension system than the spider and front gasket described herein. Such alternative implementations of the speaker subassembly are contemplated without deviating from the scope or spirit of the claimed invention.

Moreover, descriptions of well-known apparatuses and methods may be omitted from the present description so as to not obscure the description of the representative embodiments. Such methods and apparatuses are clearly within the scope of the claimed invention.

Referring to FIG. 1A through FIG. 10B, various aspects of a variable flux speaker having a variable flux speaker subassembly are shown. Referring initially to FIG. 1A through FIG. 1D, a first embodiment of a variable flux speaker 1 is shown. The variable flux speaker 1 has a cone 12. One end of the cone 12 is coupled to a top side of a frame 20 and is interposed between the frame 20 and a front gasket or surround 16. A rear gasket 17 is provided on the frame 20 opposite the front gasket 16 and may help reduce noises caused by vibration between the frame 20 and an enclosure. The other end of the cone 12 is coupled to a voice coil structure 55 and one end of a spider 14. The other end of the spider 14 (opposite the spider's 14 connection with the voice coil structure 55) is coupled to a seat formed in the frame 20. The voice coil structure 55 has voice coil wiring therein.

The cone 12 and spider 14 are coupled to the voice coil structure 55 and support the voice coil wiring within a voice coil air gap 48 formed between a pole piece 60 and a top plate 46 of the speaker subassembly 40. The voice coil structure 55 is substantially concentrically disposed about the pole piece 60. The voice coil structure 55 has a substantially circular cross-section in the depicted embodiment. In alternative embodiments the voice coil structure 55 may have other cross-sections such as, for example, rectangular or hexagonal. A dust cap 18 is mounted to the cone 12 and overlies the voice coil structure 55 and pole piece 60 to thereby protect them from contaminants and/or damage. A terminal 22 is mounted on the frame 20 and may be placed in electrical communication with the voice coil wiring of the voice coil structure 55 via electrical wiring (not shown). The terminal 22 may also be placed in electrical communication with an audio input such as, for example, an audio input of a speaker enclosure.

The top plate 46 has a top plate opening 47 therethrough and is positioned around the voice coil structure 55 and the pole piece 60. A back plate 42 of the speaker subassembly 40 is spaced apart from the top plate 46 and has a back plate opening 43 therethrough. A magnet 50 of the speaker subassembly 40 is interposed between the top plate 46 and the back plate 42. The magnet surrounds and defines a magnet opening 51. The magnet opening 51 is accessible through the top plate opening 47. The pole piece 60 is positioned interiorly of the top plate 46 and the magnet 50. The top plate 46 and the back plate 42 are a ferrous material. The magnet 50 may be any type of magnet but preferably is a permanent magnet such as, for example, a ceramic, ferrite, Alnico, Ticonal, or neodymium magnet. Also, in some embodiments the magnet 50 may include a plurality of individual magnet pieces.

The depicted pole piece 60 is generally T-shaped and has an upper end 62, a lower end 61, and a longitudinal axis A extending from the upper end 62 to the lower end 61. The pole piece 60 has an overhang 63 toward the upper end 62 that extends farther radially than the remainder of the pole piece 60. The pole piece 60 also has a sloped portion 64 toward the lower end 61 wherein the radial diameter of the pole piece 60 decreases as it moves toward the lower end 61. A substantially straight-walled section is provided between the overhang 63 and the sloped portion 64. A guide sleeve 66 surrounds a portion of the pole piece 60 from below the overhang 63 of the pole piece 60 to the lower end 61 of the pole piece 60. The guide sleeve 66 may be manufactured from non-ferrous material such as, for example, plastic. The guide sleeve 66 may be coupled to the pole piece 60 for example, at a location where the guide sleeve 66 is most proximal the overhang 63. The guide sleeve 66 may be coupled to the pole piece 60 using, for example, an adhesive and/or welding. In alternative embodiments the guide sleeve 66 may be otherwise coupled to the pole piece 60. For example, they may be coupled to one another using alternative mechanical affixation methods, including, but not limited to soldering, prongs, fasteners, and/or structure that may extend from guide sleeve 66 and/or pole piece 60.

A core sleeve 68 surrounds and telescopically receives the guide sleeve 66, thereby allowing the pole piece 60 to be slidably adjustable along the longitudinal axis A. The core sleeve 68 may be manufactured from ferrous material such as, for example, steel. The core sleeve 68 may be coupled to a back plate 42 using, for example, an adhesive and/or welding. In alternative embodiments the core sleeve 68 may be integrally formed with the back plate or may be otherwise coupled to the back plate 42. For example, the core sleeve 68 and back plate 42 may be coupled to one another using alternative mechanical affixation methods, including, but not limited to soldering, prongs, fasteners, and/or structure that may extend from guide sleeve 66 and/or pole piece 60. The core sleeve 68 may help to maintain the pole piece 60 in concentric alignment with the top plate 46.

An adjustment shaft 70 extends from an opening in the pole piece 60 and through the opening 43 in the back plate 42. In some embodiments the shaft 70 may be fixedly received in the opening of the pole piece 60. In other embodiments the shaft 70 may be otherwise coupled to the pole piece 60. For example, the shaft 70 may be threadedly received in the opening of the pole piece 60 and/or may be integrally formed with the pole piece 60. The shaft is also coupled to an adjustment knob 72. The knob 72 is threadedly received in a threaded extension 74. The threaded extension 74 is coupled to the back plate 42. Rotation of the knob 72 causes the knob 72 to rotate within the threaded extension 74 and move in a direction parallel with the longitudinal axis A, thereby causing the shaft 70 and pole piece 60 to likewise move in a direction parallel with the longitudinal axis A. In some embodiments the shaft 70 may be immovably coupled to both the adjustment knob 72 and the pole piece 60, thereby causing the shaft 70 and pole piece 60 to rotate as they are moved along the longitudinal axis A. In alternative embodiments the shaft 70 may be movably coupled to the adjustment knob 72 and/or the pole piece 60 to prevent the shaft 70 and/or the pole piece 60 from rotating as they are moved along the longitudinal axis A via knob 72. For example, the shaft 70 may have structure protruding radially therefrom that is bounded by corresponding notch structure in either pole piece 60 and/or knob 72.

Figure 1B:
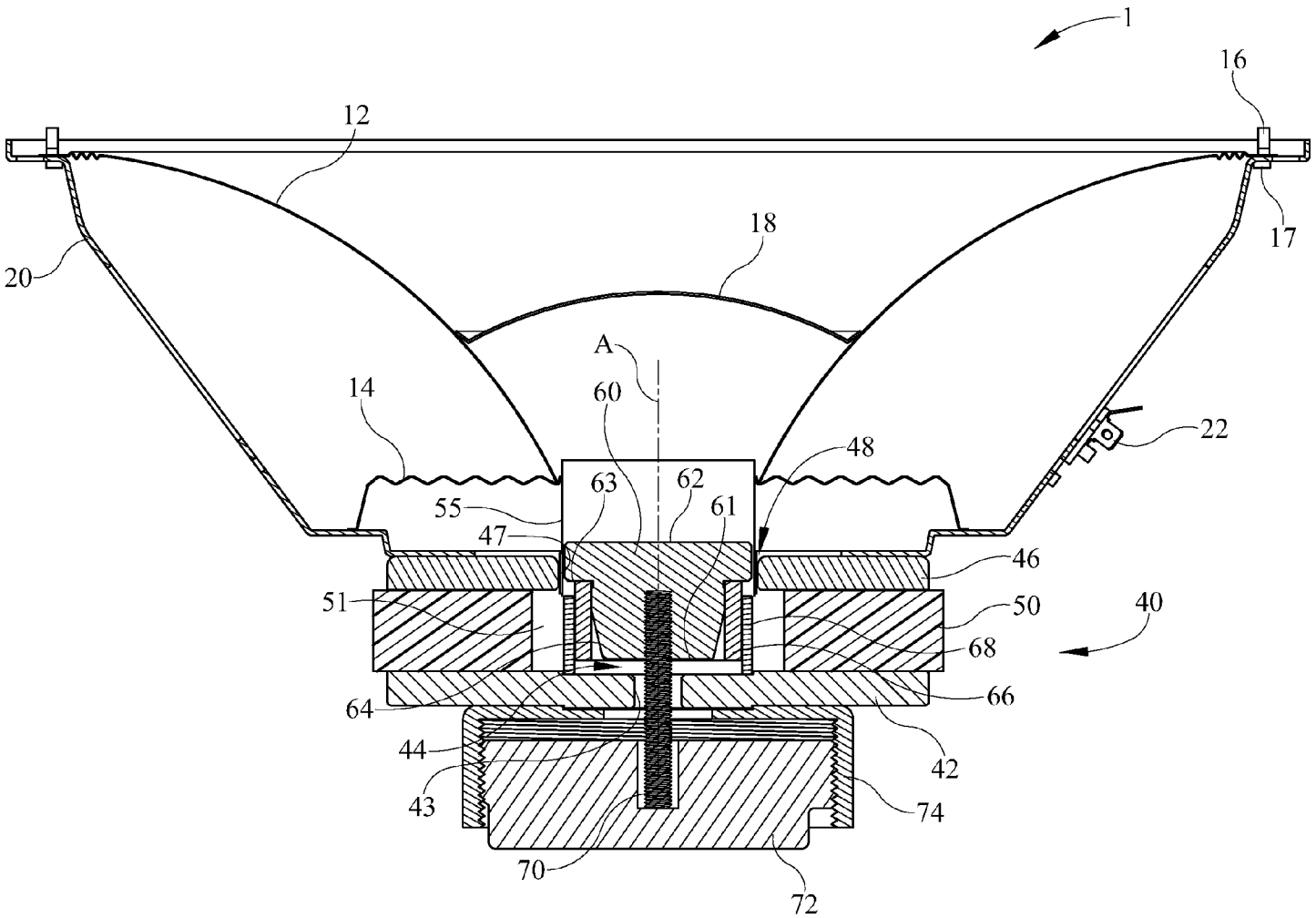
FIG. 1B illustrates the first embodiment of the variable flux speaker with the pole piece in a second position.
Figure 1C:
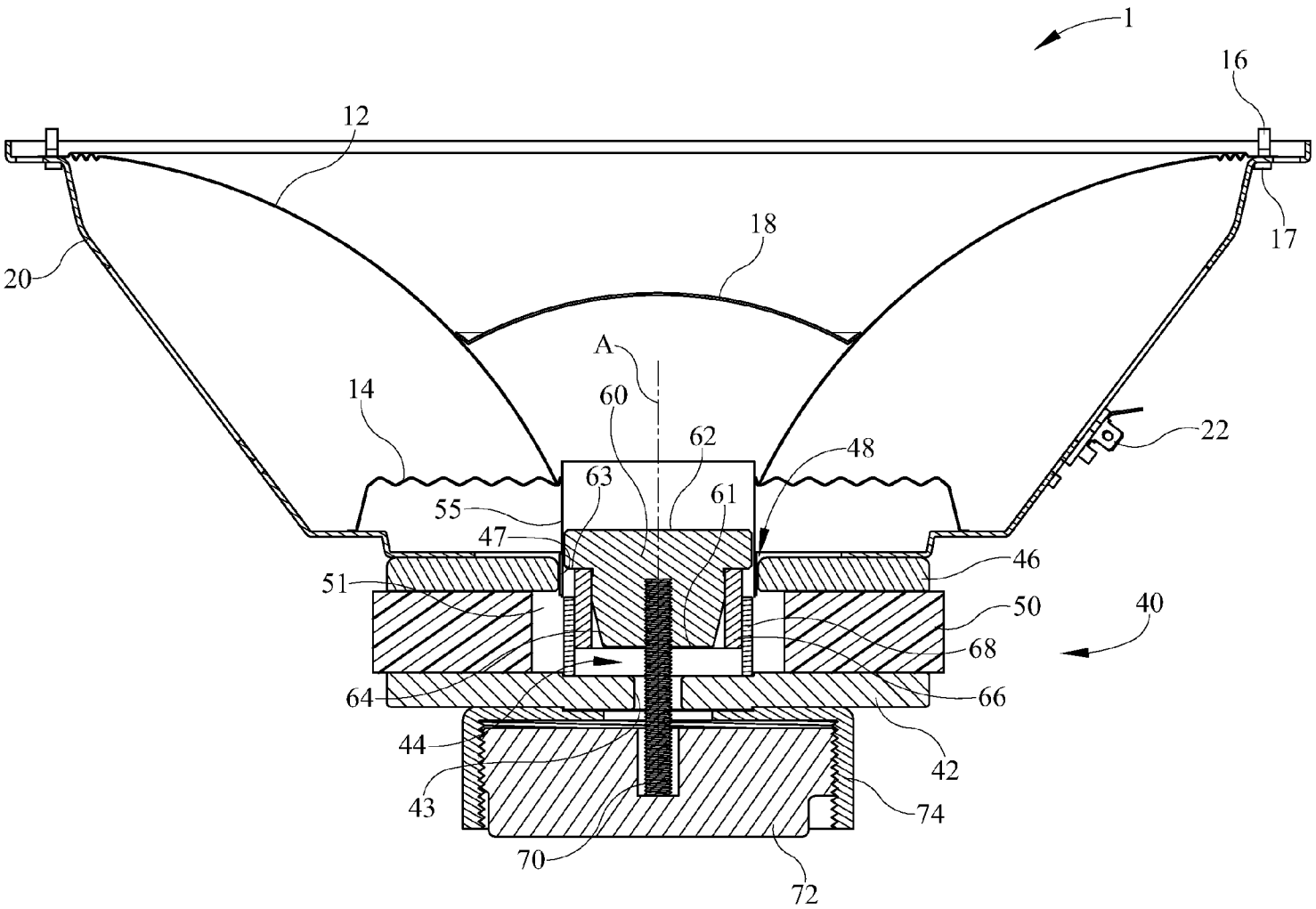
FIG. 1C illustrates the first embodiment of the variable flux speaker with the pole piece in a third position.
Figure 1D:
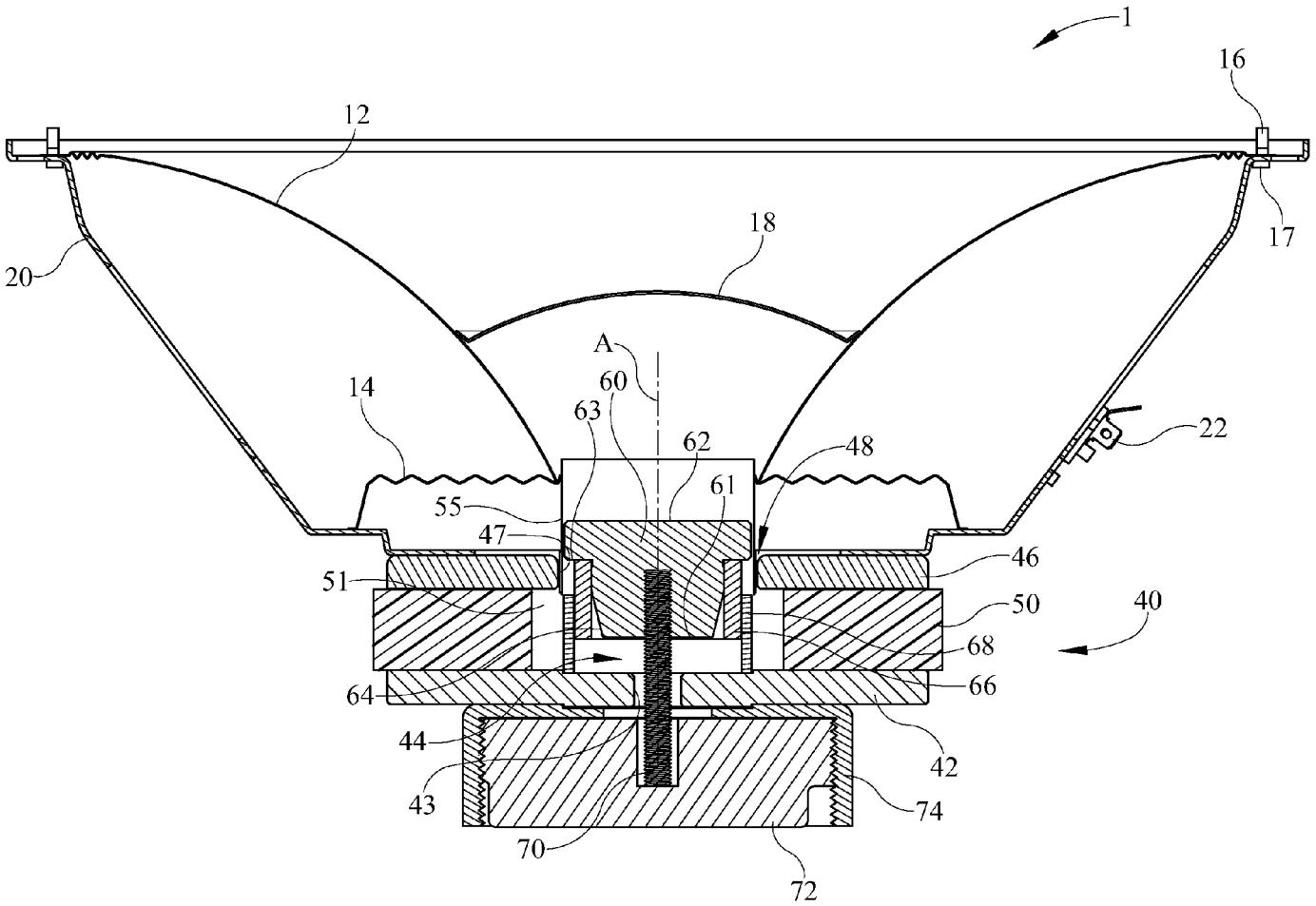
FIG. 1D illustrates the first embodiment of the variable flux speaker with the pole piece in a fourth position.

In FIG. 1A the pole piece 60 and the knob 72 are shown in a first position. In FIG. 1B the pole piece 60 and the knob 72 are shown a second position, wherein the pole piece 60 is more distal the back plate 42 than it is in the first position. In FIG. 1C the pole piece 60 and the knob 72 are shown a third position, wherein the pole piece 60 is more distal the back plate 42 than it is in the second position. In FIG. 1D the pole piece 60 and the knob 72 are shown a fourth position, wherein the pole piece 60 is more distal the back plate 42 than it is in the third position. As the pole piece 60 moves from the first position to the fourth position a gap 44 between the back plate 42 and the pole piece 60 is created and grows larger. As the pole piece 60 moves from the first position to the fourth position, the magnetic field present along the voice coil air gap 48, within which the wiring of the voice coil structure 55 is suspended, becomes weaker. Correspondingly, as the pole piece 60 moves from the first position to the fourth position a greater amount of the magnetic field is routed outside of the voice coil air gap 48. For example, as the pole piece 60 moves from the first position to the fourth position a greater amount of the magnetic field is carried by the core sleeve 68, some of which is routed outside of the voice coil air gap 48 to the core sleeve 68.

Figure 1E:
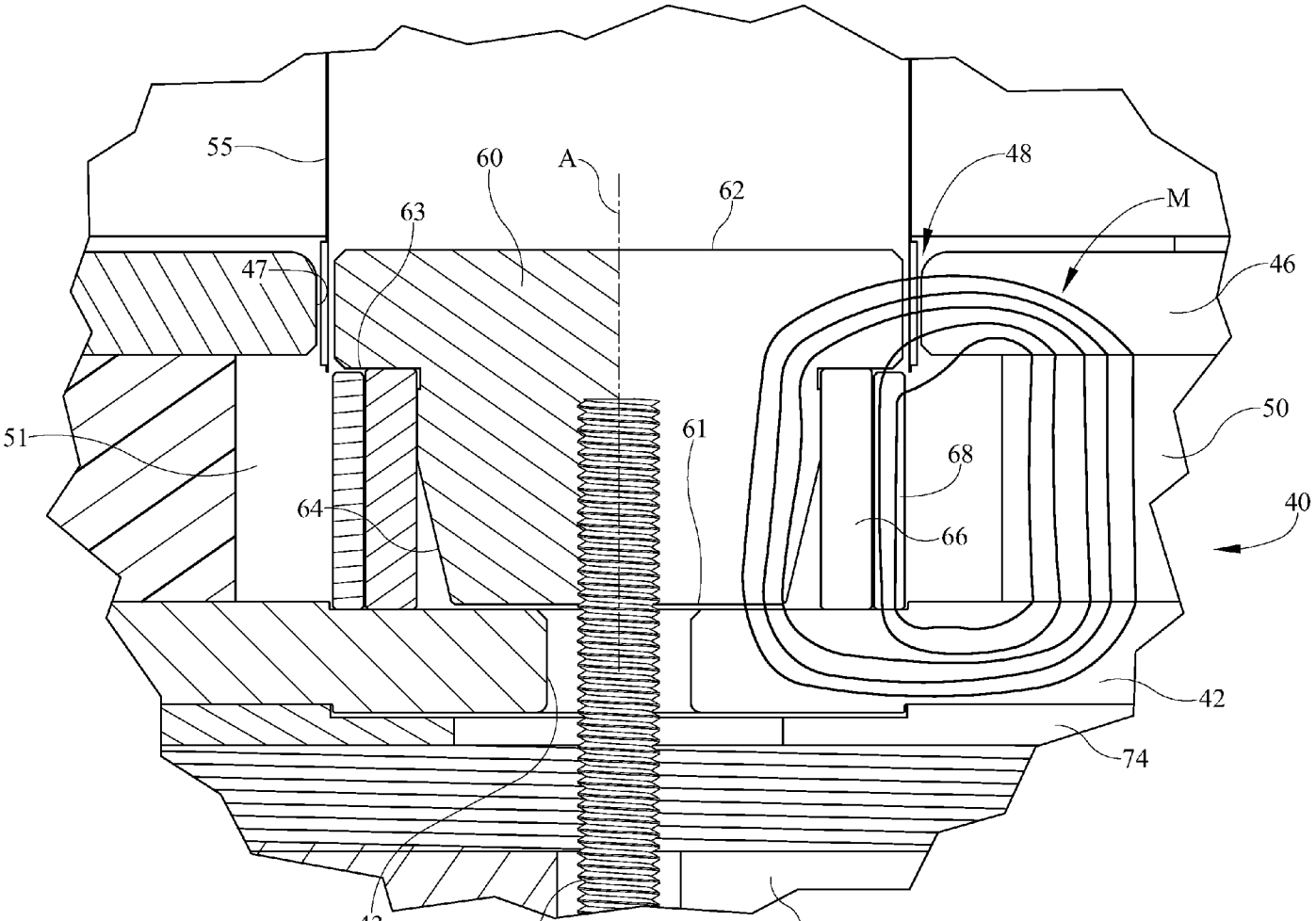
FIG. 1E illustrates a close up view of a portion of the speaker subassembly of the first embodiment of the variable flux speaker with the pole piece in the first position of FIG. 1A; a schematic depiction of magnetic flux lines through a portion of the speaker subassembly is also shown.
Figure 1F:
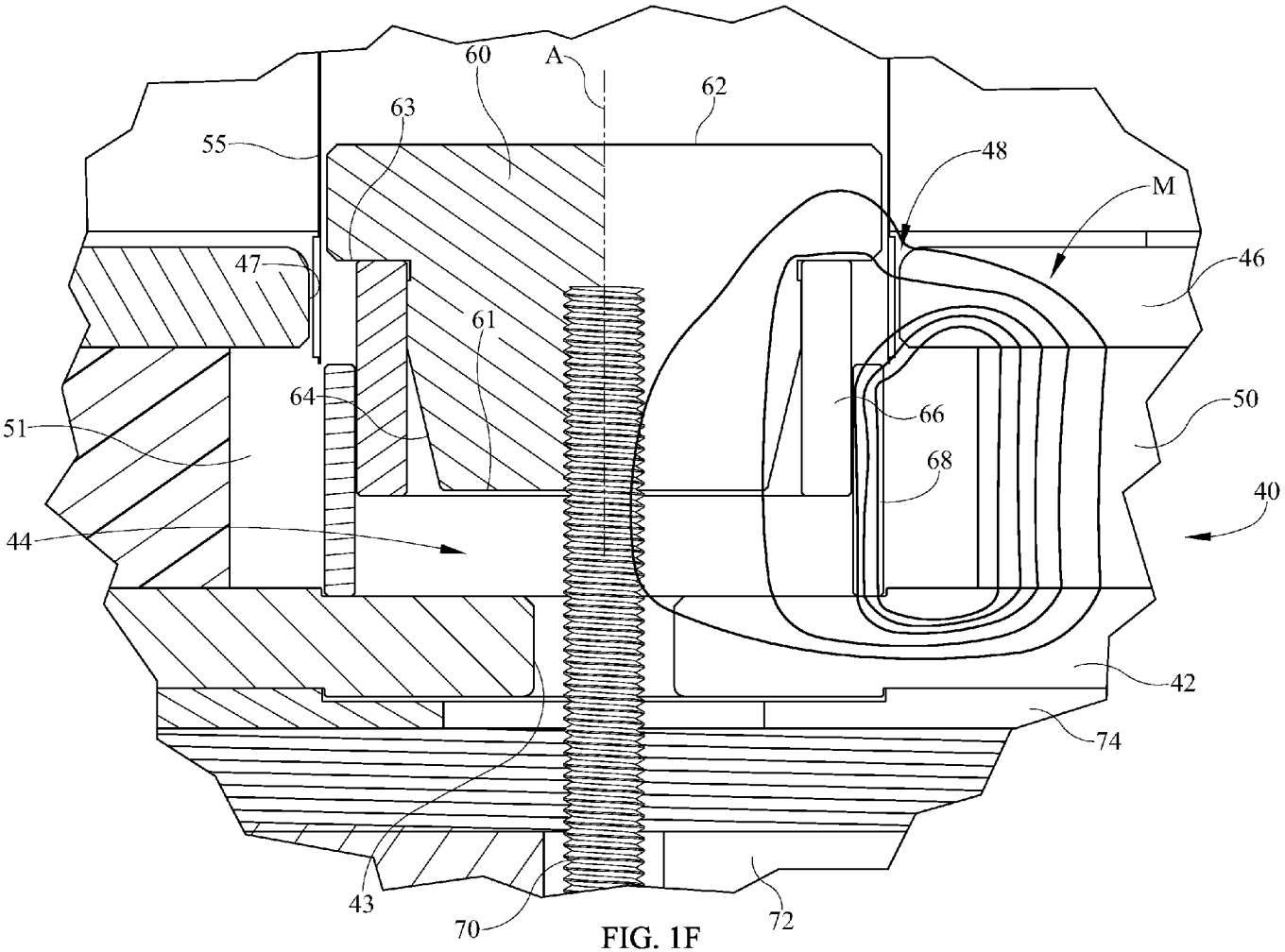
FIG. 1F illustrates a close up view of a portion of the speaker subassembly of the first embodiment of the variable flux speaker with the pole piece in the fourth position of FIG. 1D; a schematic depiction of magnetic flux lines through a portion of the speaker subassembly is also shown.

Referring now to FIG. 1E and FIG. 1F, a close up view of a portion of the speaker subassembly 40 of the speaker 1 is shown. In FIG. 1E the pole piece 60 is shown in the first position of FIG. 1A and in FIG. 1F the pole piece 60 is shown in the fourth position of FIG. 1D. In FIG. 1E and FIG. 1F the right half of the Figures are provided with a schematic depiction of magnetic flux lines. Additionally, the right half of the Figures are provided without section hatching lines for ease in viewing and understanding the schematic depiction of magnetic flux lines. In FIG. 1E it is shown that, generally speaking, the majority of the magnetic flux passes through the voice coil air gap 48 as it passes between the top plate 46 and the bottom plate 42. In FIG. 1F it is shown that, generally speaking, when the pole piece 60 is in the fourth position, the magnetic field present through and/or along the voice coil air gap 48, within which the wiring of the voice coil structure 55 is suspended, becomes weaker. In particular, as the pole piece 60 moves from the first position to the fourth position a greater amount of the magnetic field is routed outside of the voice coil air gap 48. As shown in FIG. 1F, a greater amount of the magnetic field is carried by the core sleeve 68, some of which is routed outside of the voice coil air gap 48 to the core sleeve 68. Also, a greater amount of the magnetic field is routed outside of the voice coil air gap 48 while being transferred to the pole piece 60. It is understood that the schematic depiction of magnetic flux lines in FIG. 1E and FIG. 1F are for purposes of explanation only and that varying and/or additional flux lines may be present.

Although only four positions of the pole piece 60 are shown in FIG. 1A-D, through adjustment of the knob 72, the pole piece 60 may be positioned in any desired position between the first position and fourth position. Also, the length of the shaft 70 may be extended if desired to enable the pole piece 60 to be more distal the back plate 42 than depicted in FIG. 1D. Optionally, one or more fiducial markings may be provided on the knob 72 and/or surrounding the knob 72 to provide a user with one or more reference points for adjusting the knob 72 to a desired position.

Although a knob 72 that threadedly engages a threaded extension 74 and is coupled to a shaft 70 is shown, one of ordinary skill in the art, having had the benefit of the present disclosure, will realize that additional or alternative structure may be used to effectuate linear displacement of the pole piece 60. For example, in some embodiments alternative adjustment structure and/or methods described herein in conjunction with other embodiments of the speaker subassembly 40 may be adapted for use in adjusting pole piece 60. Also, for example, in some embodiments an electronic bi-directional motor may be coupled to the knob 72 and may be selectively activated by a user to cause the knob 72 to rotate either clockwise or counter-clockwise. Also, for example, in alternative embodiments a mechanical, electronic, and/or an electro-mechanical linear actuator may be coupled to the pole piece 60 and may be actuated by a user to cause the pole piece 60 to be linearly displaced. Such linear actuators include, but are not limited to hydraulic actuators, pneumatic actuators, piezoelectric actuators, linear motors, wax motors, segmented spindles, a moving coil, and a jack screw. Also, for example, in alternative embodiments a cable (for example, an aircraft cable) could be coupled directly or indirectly to the pole piece 60 and force applied to the cable (for example, through a foot pedal) to cause the pole piece 60 to be linearly displaced. Optionally, in such embodiments the pole piece 60 may be coupled to a biasing spring that urges the pole piece 60 back toward a preselected position. In some embodiments a controller may optionally be in electrical communication with the motor, linear actuator, or cable and direct the displacement of the pole piece 60. For example, in some embodiments a controller may be in electrical communication with a dial that enables a user to select a desired amount of attenuation and will adjust the displacement of pole piece 60 correspondingly to the user's selection on the dial.

The term "controller" is used herein generally to describe various apparatus relating to the operation of one or more speakers. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

Figure 2:
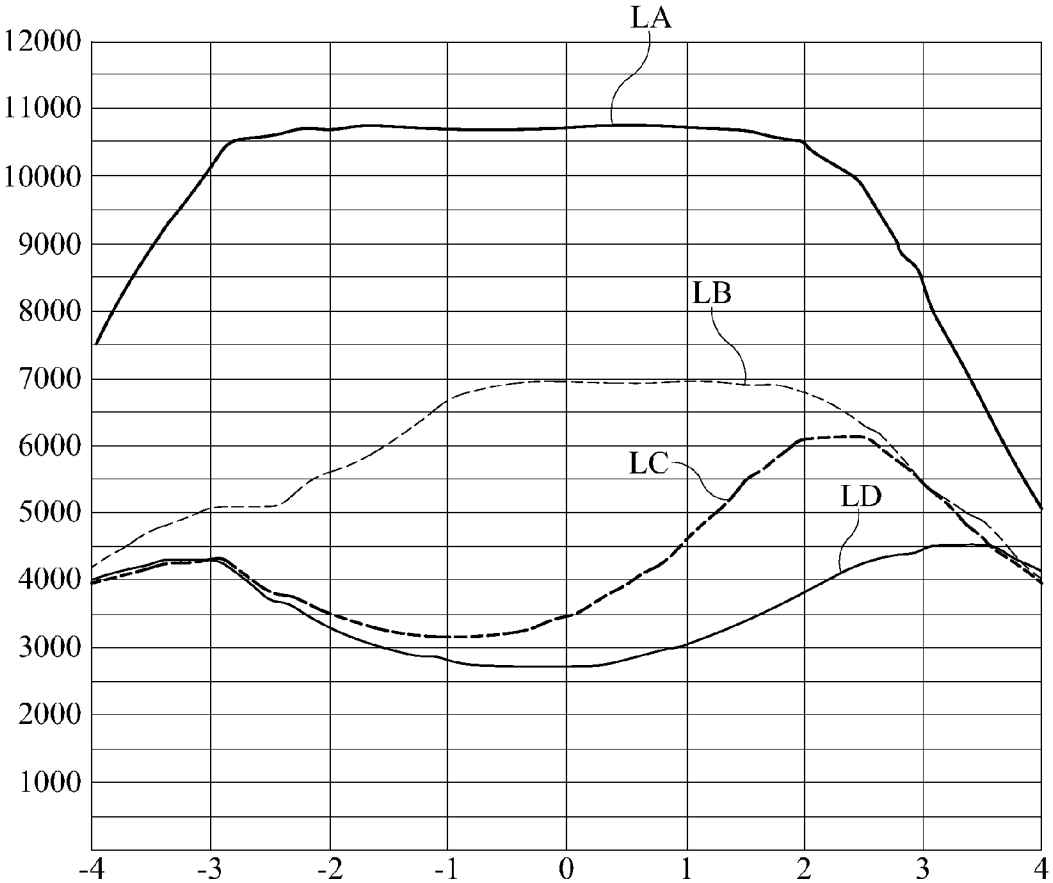
FIG. 2 illustrates a graphical depiction of the magnetic field, in Gauss, along the voice coil air gap adjacent the top plate of the speaker subassembly of the first embodiment of the speaker; four lines are shown, illustrating the magnetic field with the pole piece in the first position, second position, third position, and fourth position.

Referring to FIG. 2, a graphical depiction of the magnetic field, in Gauss, along the voice coil air gap 48 adjacent the top plate 46 and within which the voice coil wiring of the voice coil structure 55 is suspended, is shown. The horizontal axis values correspond to locations within the voice coil air gap 48. The leftmost horizontal value is substantially in line with the face of the top plate 46 that is adjacent the magnet 50. The rightmost horizontal value is substantially in line with the face of the top plate 46 that is opposite the magnet 50. The vertical axis values correspond to the magnetic field strength, in decigrams. Four distinct lines are shown. Line LA corresponds to the pole piece 60 in the first position, line LB corresponds to the pole piece 60 in the second position, line LC corresponds to the pole piece 60 in the third position, and line LD corresponds to the pole piece 60 in the fourth position. As shown, as the pole piece 60 moves from the first position to the fourth position, the magnetic field along the voice coil air gap 48 generally decreases.

Figure 3A:
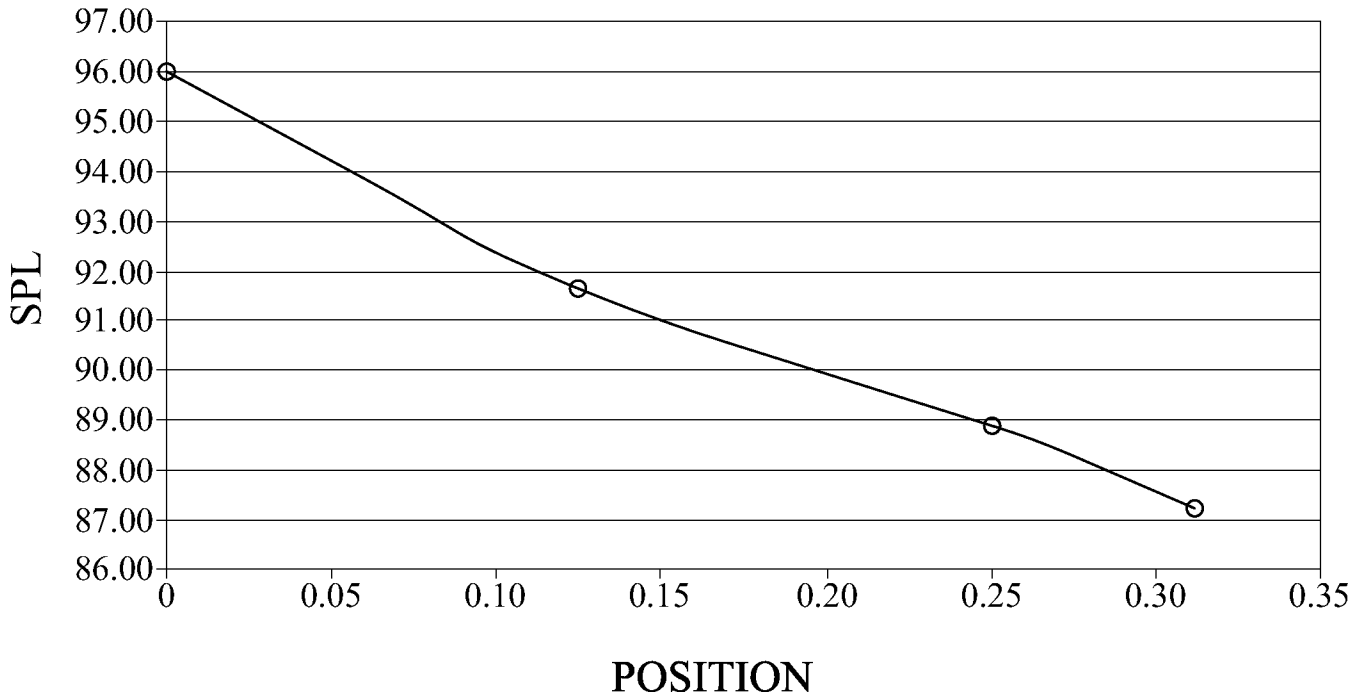
FIG. 3A illustrates a graphical depiction of the sound pressure level, in decibels, of the first embodiment of the speaker at various positions of the pole piece.

Referring to FIG. 3A, a graphical depiction of the sound pressure level, in decibels, of the speaker 1 is shown at various positions of the pole piece 60. The horizontal axis values correspond to the distance, in inches that the lower end 61 of the pole piece 60 is displaced from the back plate 42. The vertical axis values correspond to the sound pressure level generated by the speaker, in decibels. The mark at zero corresponds to the pole piece 60 in the first position (FIG. 1A), the mark at 0.125" corresponds to the pole piece 60 in the second position (FIG. 2A), the mark at 0.250" corresponds to the pole piece 60 in the third position (FIG. 1C), and the mark at 0.312" corresponds to the pole piece 60 in the fourth position (FIG. 1D). As shown, as the pole piece 60 moves from the first position to the fourth position, the sound pressure level of the speaker 1 decreases.

Referring to FIG. 3B, a table illustrates various characteristics of the speaker 1 when the pole piece 60 is in the first position, second position, third position, and fourth position. Namely, the average magnetic field (B), in kilogauss is shown, the percentage change of the magnetic field from the preceding position is shown, the sound pressure level (SPL) is shown, the sound pressure level drop from the preceding position is shown, and the Qes is shown. As understood by those of skill in the art, Qes is a measurement of the control coming from the speaker's electrical system; the interaction of coil and magnetic flux. Generally speaking, as the pole piece 60 moves from the first position to the fourth position the average magnetic field decreases, the sound pressure level decreases, and the Qes increases. Also, generally speaking, as the pole piece 60 moves from the first position to the fourth position the high frequency volume compared to the low frequency volume is decreased. As a result, a user of the speaker 1 may effectively increase the "warmth" of the tone coincidentally with decreases in output. Such an increase in warmth of the tone coincident with decreases in output may be achieved independently of the amp drive level and may allow a user to overdrive the amp to achieve a desired sound while maintaining a desirable output level.

Figure 4:
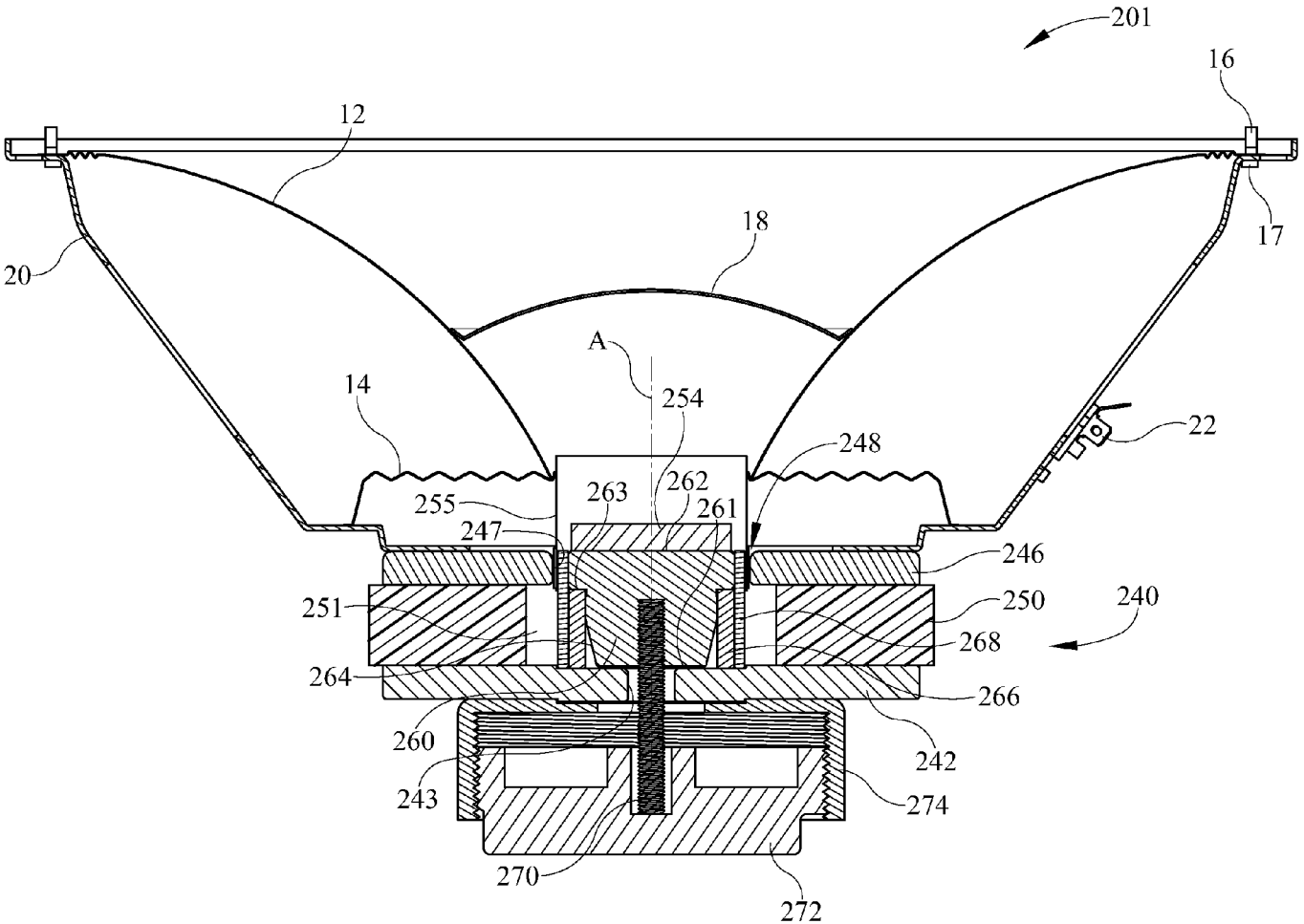
FIG. 4 illustrates a second embodiment of a variable flux speaker with a pole piece of a speaker subassembly of the speaker in a first position.

Referring to FIG. 4, a second embodiment of a variable flux speaker 201 is shown. Variable flux speaker 201 is similar to variable flux speaker 1 and like reference numerals refer to like parts of the two. However, variable flux speaker 201 is provided with a secondary magnet 254 atop the pole piece 260. The secondary magnet 254 may increase the magnetic field present along the voice coil air gap 248 if placed in a first polar orientation or may decrease the magnetic field present along the voice coil air gap 248 if placed in a second polar orientation. The secondary magnet 254 is secured atop the pole piece 260 and moves along with the pole piece 260. Also, the overhang 263 of the pole piece 260 does not extend as far radially as the overhang 63 of the pole piece 60. Additionally, the core sleeve 268 extends to the upper end 262 of the pole piece 260 instead of terminating below the overhangs 263.

Figure 5A:
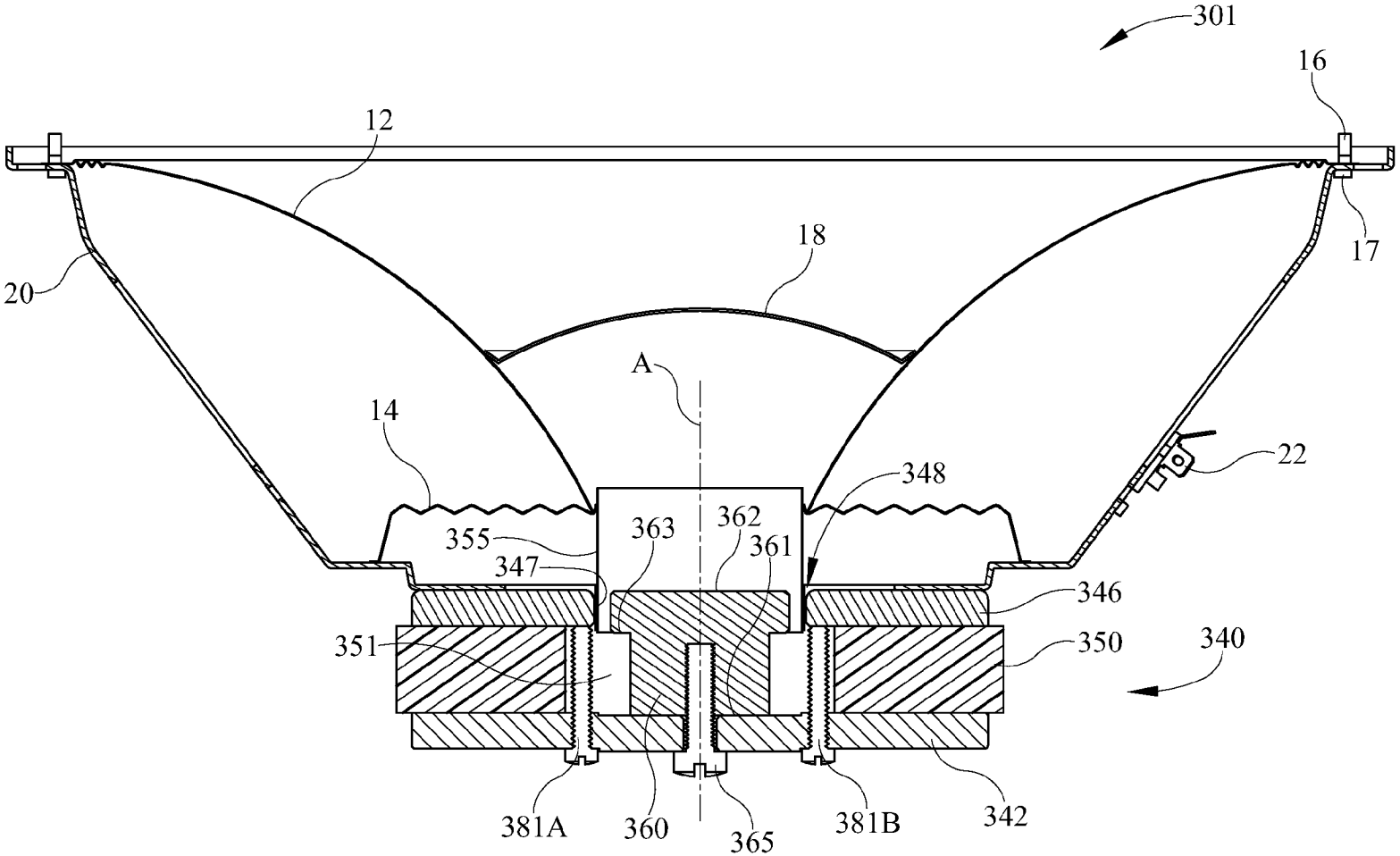
FIG. 5A illustrates a third embodiment of a variable flux speaker with two rods of a speaker subassembly of the speaker in a first position.
Figure 5B:
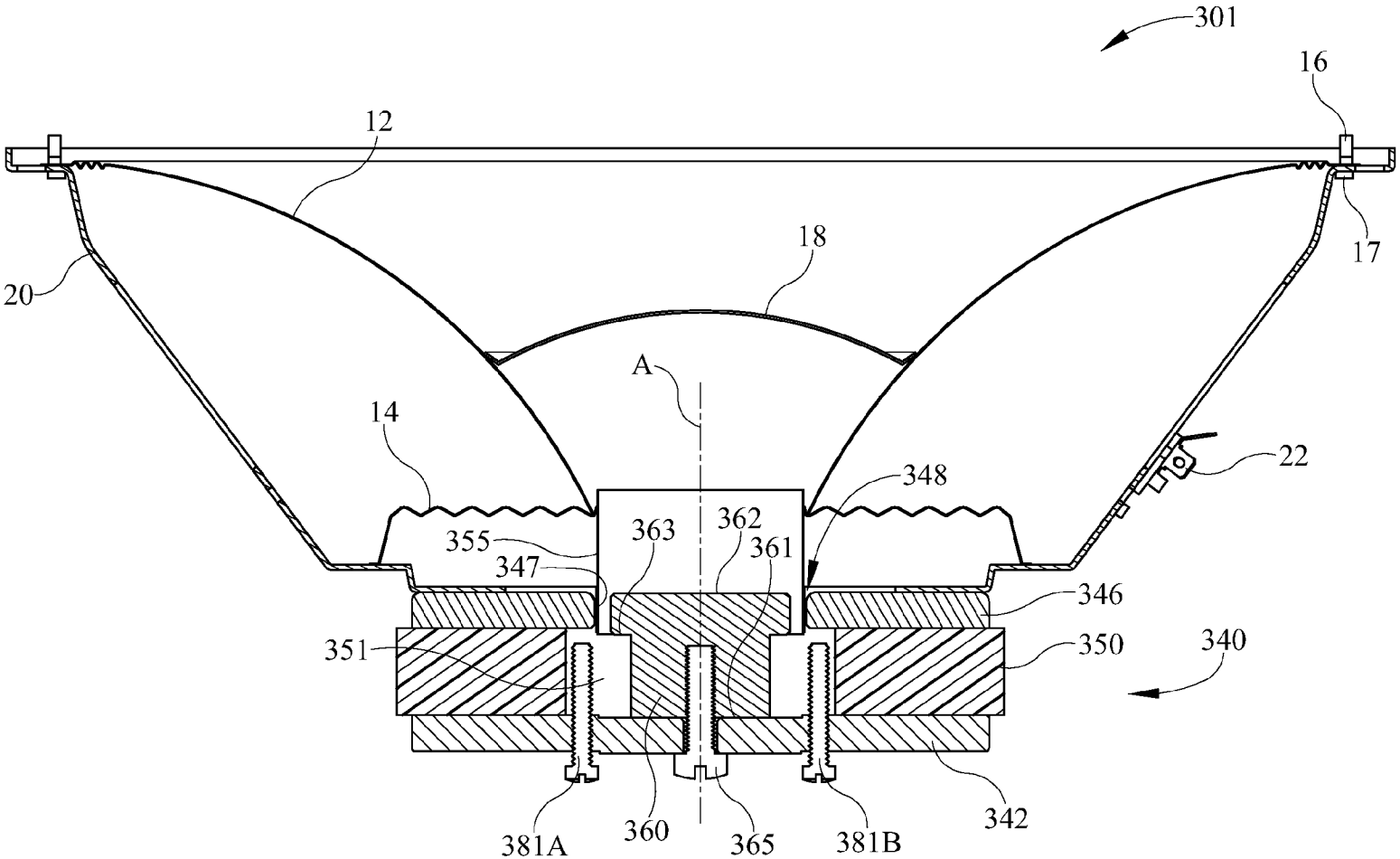
FIG. 5B illustrates the third embodiment of the variable flux speaker with the rods in a second position.

Referring to FIGS. 5A and 5B, a third embodiment of a variable flux speaker 301 is shown. The top plate 346 has a top plate opening 347 therethrough and is positioned around the voice coil structure 355 and the pole piece 360. A back plate 342 of the speaker subassembly 340 is spaced apart from the top plate 346. A magnet 350 of the speaker subassembly 340 is interposed between the top plate 346 and the back plate 342. The magnet surrounds and defines a magnet opening 351. The magnet opening 351 is accessible through the top plate opening 347. The pole piece 360 is positioned interiorly of the top plate 346 and the magnet 350.

The depicted pole piece 360 is generally T-shaped in cross section and has an upper end 362, a lower end 361, a longitudinal axis A, and an overhang 363 toward the upper end 362 that extends farther radially than the remainder of the pole piece 360. A substantially straight-walled section is provided between the overhang 363 and the lower end 361. A fastener 365 extends through an opening 343 in the back plate 342 and is threadedly received in the pole piece 360 to fixedly secure the pole piece 360 in position.

A first ferrous threaded rod 381A and a second ferrous threaded rod 381B are in contact with and threadedly received through the back plate 342 and extend into the magnet opening 351 between the pole piece 360 and the magnet 350. The rods 381A and 381B are aligned substantially parallel with the longitudinal axis A of the pole piece 360. In FIG. 5A the rods 381A and 381B are shown in a first position wherein they are substantially in contact with the top plate 346. In FIG. 5B the rods 381A and 381B are shown in a second position wherein they are spaced apart from the top plate 346. The rods 381A and 381B may be individually threadedly adjusted to be spaced apart a larger distance from the top plate 346 than depicted in FIG. 5B and may also be threadedly adjusted to be spaced apart a smaller distance from the top plate 346 than depicted in FIG. 5B. The rods 381A and 381B route magnetic flux away from the voice coil air gap 348 formed between the pole piece 360 and the top plate 346 of the speaker subassembly 340.

When the rods 381A and 381B are in the first position of FIG. 5A they route a greater amount of flux away from the voice coil air gap 348 than when they are in the second position of FIG. 5B. In other words, when the rods 381A and 381B are in the first position of FIG. 5A, more magnetic flux is routed through the rods 381A and 381B than when they are in the second position of FIG. 5B. Generally speaking, when the rods 381A and 381B move from the first position of FIG. 5A to the second position of FIG. 5B, the amount of magnetic flux passing through the voice coil air gap 348 increases. This is akin to the pole piece 60 moving from the fourth position of FIG. 1D to the first position of FIG. 1A, wherein the amount of flux passing through the voice coil air gap 48 also increases (although it may increase by a different amount). Accordingly, generally speaking, as the rods 381A and 381*b* are moved from the first position to the second position the average magnetic field present in the voice coil air gap 348 increases, the sound pressure level of the speaker 301 increases, and the Qes decreases. Optionally, the rods 381A and/or 381B may be sized, provided with stop structure, and/or interact with stop structure to limit their range of movement. For example, in some embodiments the rods 381A and/or 381B may be sized to only extend to a preselected depth within the magnet opening 351 (for example, spaced apart a preselected distance from the top plate 384) and/or provided with stop structure so as to not be completely removable from within the magnet opening 351.

In other embodiments more or fewer rods 381A and 381B may be provided. The rods 381A and 381B may also be unthreaded and/or simultaneously adjustable in other embodiments. For example, in some embodiments the rods 381A and 381B may be unthreaded and extend through unthreaded openings through the back plate 342. The rods 381A and 381B may be coupled to adjustment structure similar to knob 72 of the first embodiment that is threadedly engaged with structure similar to threaded extension 74 of the first embodiment. The adjustment structure may then be threadedly adjusted to thereby cause the rods 381A and 381B to move between a first position proximal to the top plate 346 to a second position more distal the top plate 346 than the first position. Also, for example, in some embodiments the rods 381A and 381B may be unthreaded and coupled to at least one linear actuator (for example, coupled to a linear actuator that is coupled to a plate in contact with both of the rods 381A and 381B). Also, for example, in some embodiments the rods 381A and 381B may be removably received in unthreaded openings through the back plate 342. In such embodiments a user may choose to not insert either of the rods 381A and 381B in the openings through the back plate 342 to cause a first magnetic field to be present in the voice coil air gap 348. The user may choose to insert just one of the rods 381A and 381B in one of the openings to cause a second magnetic field to be present in the voice coil air gap 348 that is less than the first magnetic field. The user may choose to insert both of the rods 381A and 381B in the openings to cause a third magnetic field to be present in the voice coil air gap 348 that is less than the second magnetic field.

One of ordinary skill in the art, having had the benefit of the present disclosure, will realize that additional or alternative structure may be used to effectuate linear displacement of the rods 381A and 381B. For example, in some embodiments alternative adjustment structure and/or methods described herein in conjunction with other embodiments of the speaker subassembly 340 may be adapted for use in adjusting the rods 381A and 381B. For example, in some embodiments an electronic bi-directional motor or a linear actuator may be coupled to the rods 381A and 381B and may be selectively activated by a user to cause the rods 381A and 381B to be repositioned. In some embodiments a controller may optionally be in electrical communication with the motor or electronic linear actuator and direct the displacement of the rods 381A and 381B.

Figure 6A:
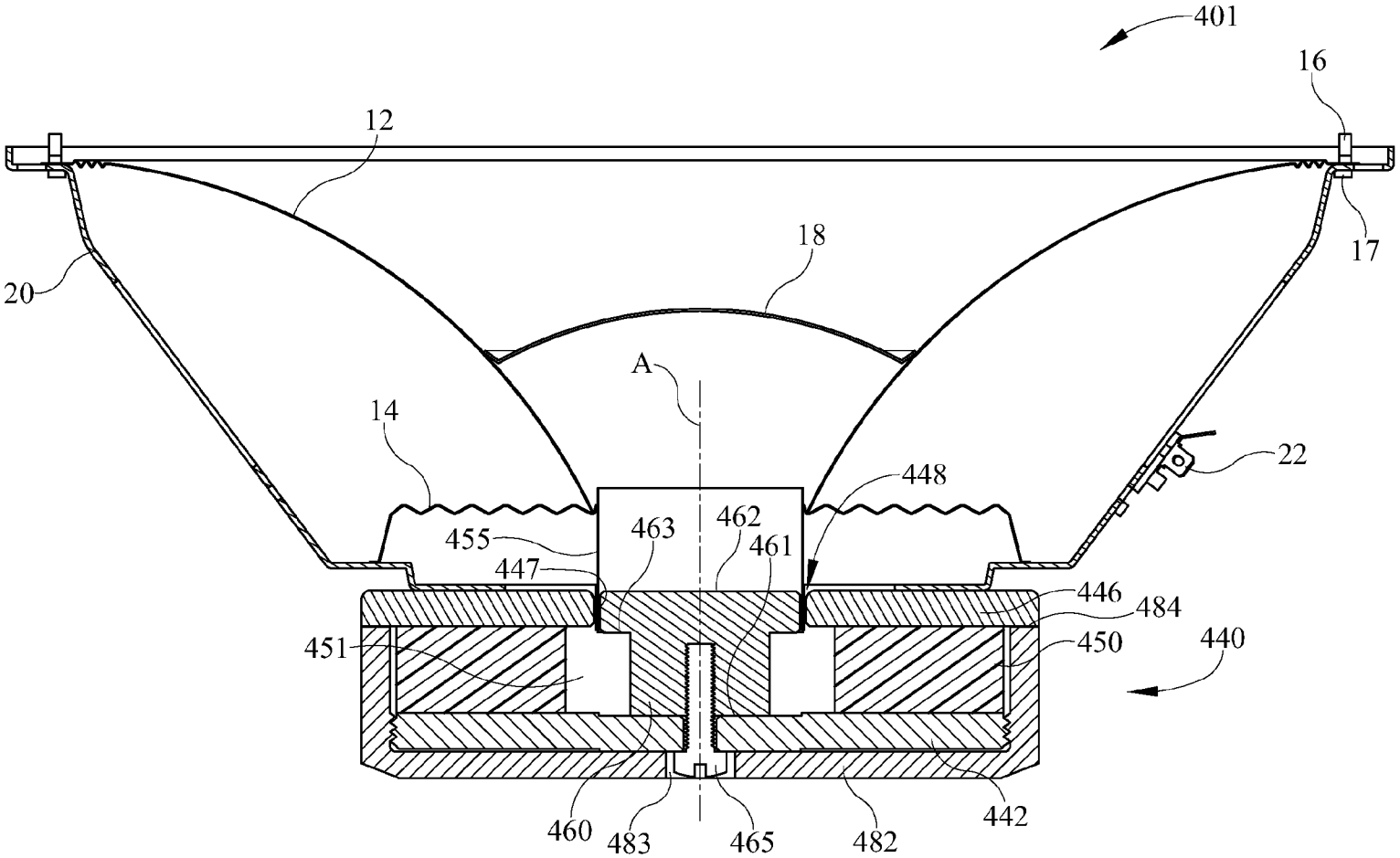
FIG. 6A illustrates a fourth embodiment of a variable flux speaker with a shorting cup of a speaker subassembly of the speaker in a first position.
Figure 6B:
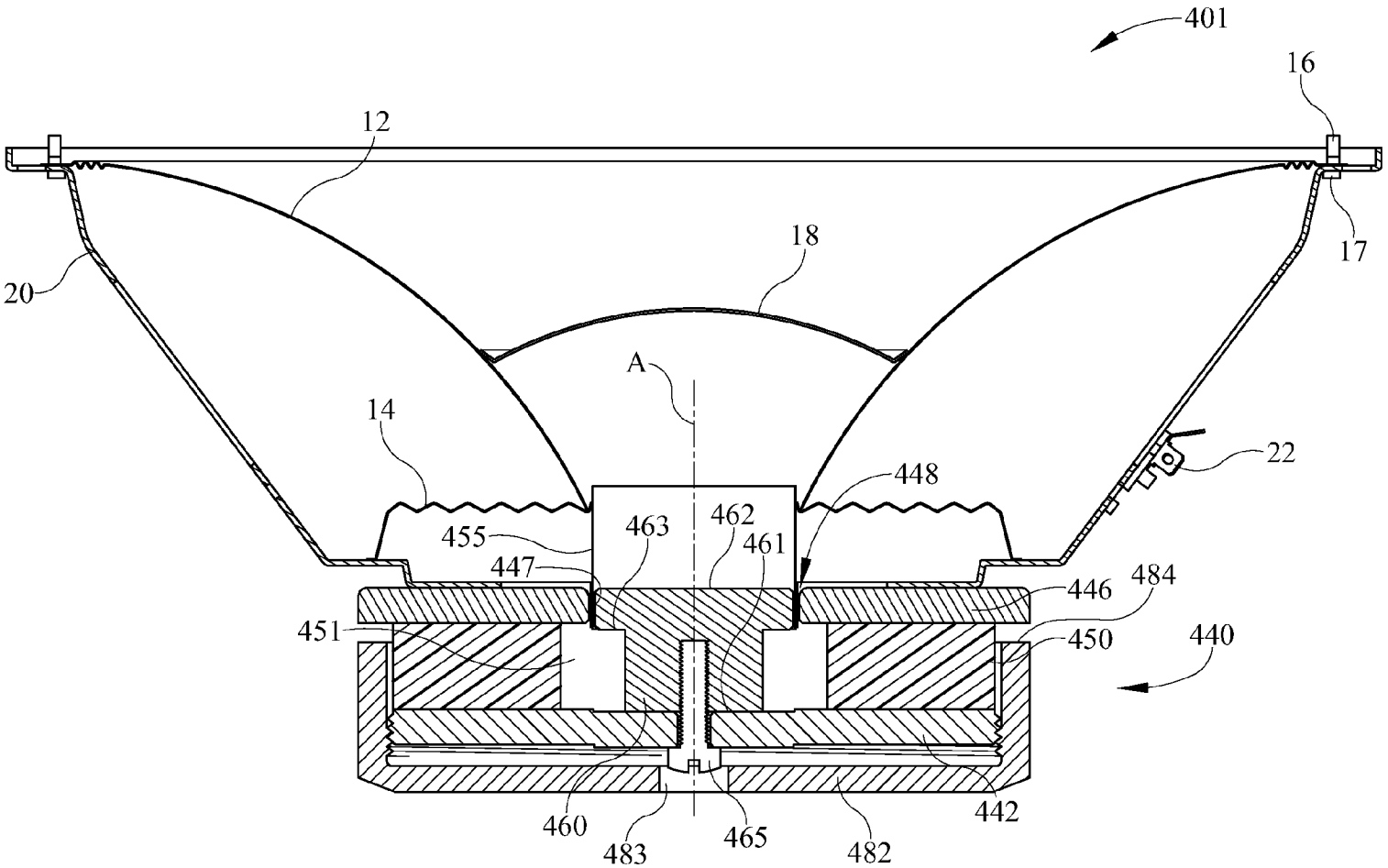
FIG. 6B illustrates the fourth embodiment of the variable flux speaker with the shorting cup in a second position.

Referring to FIGS. 6A and 6B, a fourth embodiment of a variable flux speaker 401 is shown. The top plate 446 has a top plate opening 447 therethrough and is positioned around the voice coil structure 455 and the pole piece 460. A back plate 442 of the speaker subassembly 440 is spaced apart from the top plate 446. A magnet 450 of the speaker subassembly 440 is interposed between the top plate 446 and the back plate 442. The magnet surrounds and defines a magnet opening 451. The magnet opening 451 is accessible through the top plate opening 447. The pole piece 460 is positioned interiorly of the top plate 446 and the magnet 450.

The depicted pole piece 460 is generally T-shaped in cross section and has an upper end 462, a lower end 461, a longitudinal axis A, and an overhang 463 toward the upper end 462 that extends farther radially than the remainder of the pole piece 460. A substantially straight-walled section is provided between the overhang 463 and the lower end 461. A fastener 465 extends through an opening 443 in the back plate 442 and is threadedly received in the pole piece 460 to fixedly secure the pole piece 460 in position.

A ferrous shorting cup 482 is in contact with and threadedly engages an outer diameter of the back plate 442 and surrounds an outer diameter of the magnet 450. The shorting cup 482 has an opening 483 to accommodate the head of the fastener 465. In FIG. 6A the shoring cup 482 is shown in a first position where an upper edge 484 thereof is substantially in contact with the top plate 446. In FIG. 6B the shorting cup 482 is shown in a second position wherein the upper end 484 thereof is spaced apart from the top plate 446. The shorting cup 482 may be threadedly adjustable to be spaced apart a larger distance from the top plate 446 than depicted in FIG. 6B and/or may be threadedly adjustable to be spaced apart a smaller distance from the top plate 446 than depicted in FIG. 6B. The shorting cup 482 routes magnetic flux away from the voice coil air gap 448 formed between the pole piece 460 and the top plate 446 of the speaker subassembly 440. When the shorting cup 482 is in the first position of FIG. 6A it routes a greater amount of flux away from the voice coil air gap 448 than when it is in the second position of FIG. 6B. In other words, when the shorting cup 482 is in the first position of FIG. 6A a greater amount of magnetic flux is routed through the shorting cup 482 than when it is in the second position of FIG. 6B. Generally speaking, when the shorting cup 482 moves from the first position of FIG. 6A to the second position of FIG. 6B, the amount of magnetic flux passing through the voice coil air gap 448 increases. This is akin to the pole piece 60 moving from the fourth position of FIG. 1D to the first position of FIG. 1A, wherein the amount of flux passing through the voice coil air gap 48 also increases (although it may increase by a different amount). Accordingly, generally speaking, as the shorting cup 482 is moved from the first position to the second position the average magnetic field present in the voice coil air gap 448 increases, the sound pressure level of the speaker 401 increases, and the Qes decreases.

In some embodiments the shorting cup 482 may be alternatively or additionally threadedly coupled to the outer diameter of the magnet 450. Also, in some embodiments the shorting cup 482 may be sized, provided with stop structure, and/or interact with stop structure to limit its range of movement. For example, in some embodiments the shorting cup 482 may be sized such that the upper edge 484 may only extend to a preselected distance away from the top plate 446 and not actually contact the top plate 446 when fully threaded onto the back plate 442. Also, for example, in some embodiments stop structure may interact with the shorting cup 482 to prevent the shorting cup 482 from being completely removed from the back plate 442.

One of ordinary skill in the art, having had the benefit of the present disclosure, will realize that additional or alternative structure may be used to effectuate linear displacement of the shorting cup 482. For example, in some embodiments alternative adjustment structure and/or methods described herein in conjunction with other embodiments of the speaker subassembly 440 may be adapted for use in adjusting the shorting cup 482. For example, in some embodiments an electronic bi-directional motor may be coupled to the shorting cup 482 and may be selectively activated by a user to cause the shorting cup 482 to be rotated and repositioned. Also, for example, in some embodiments the shorting cup 482 may be unthreaded and coupled to a linear actuator to cause the shorting cup 482 to be repositioned. In some embodiments a controller may optionally be in electrical communication with the motor or electronic linear actuator and direct the displacement of the shorting cup 482.

Figure 7A:
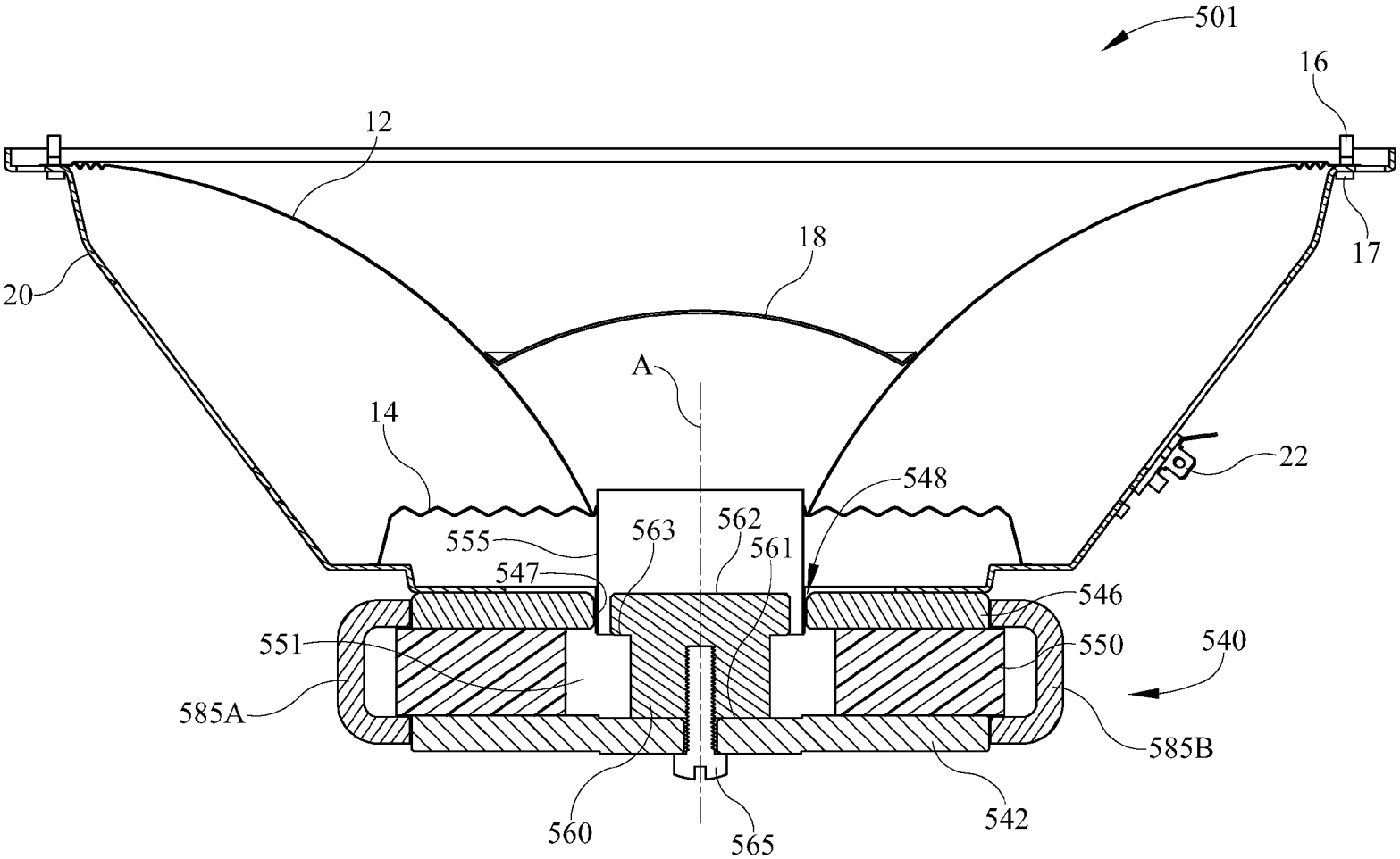
FIG. 7A illustrates a fifth embodiment of a variable flux speaker with a shorting bar of a speaker subassembly of the speaker in a first position.
Figure 7B:
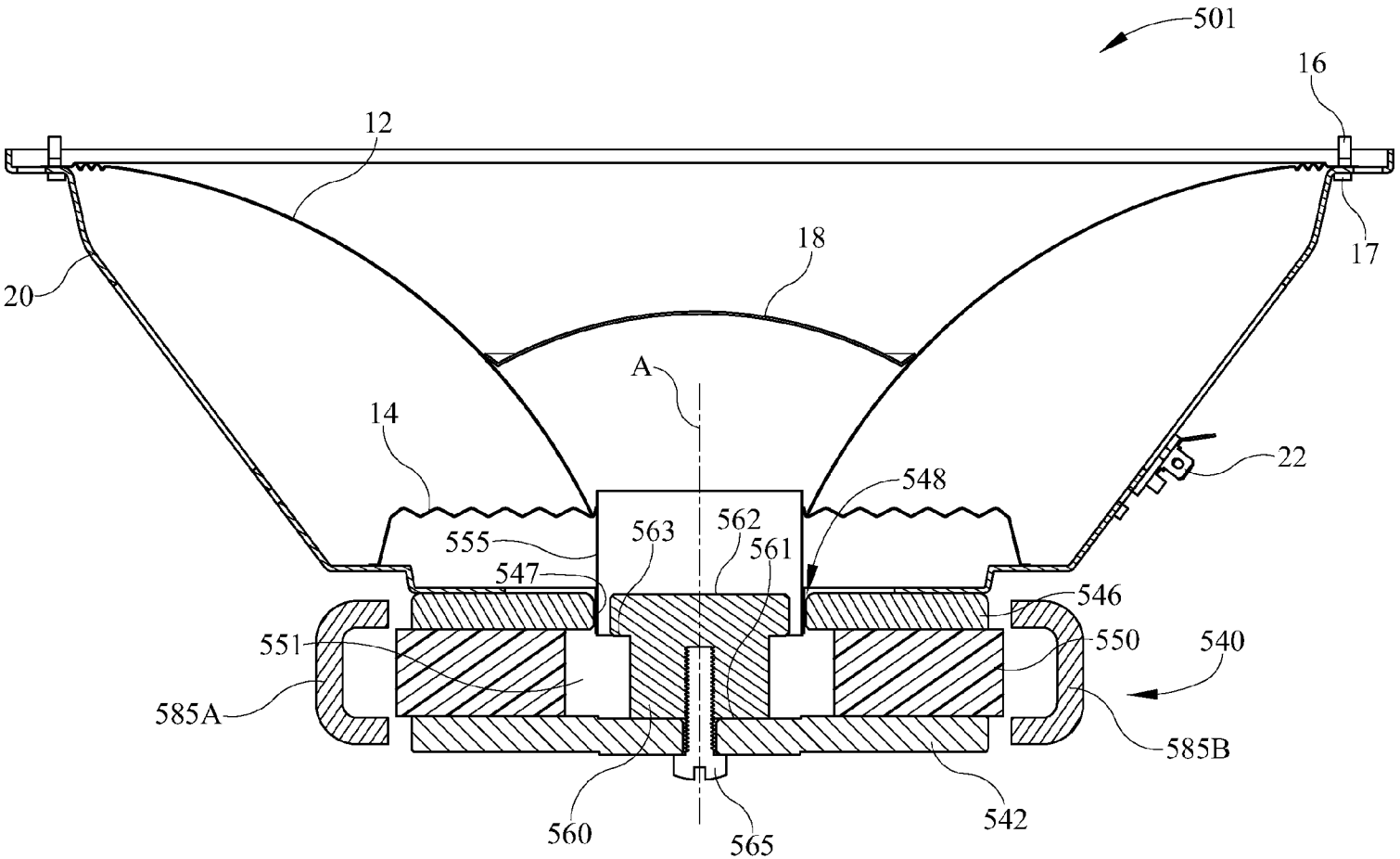
FIG. 7B illustrates the fifth embodiment of the variable flux speaker with the shorting bar in a second position.

Referring to FIGS. 7A and 7B, a fifth embodiment of a variable flux speaker 501 is shown. The top plate 546 has a top plate opening 547 therethrough and is positioned around the voice coil structure 555 and the pole piece 560. A back plate 542 of the speaker subassembly 540 is spaced apart from the top plate 546. A magnet 550 of the speaker subassembly 540 is interposed between the top plate 546 and the back plate 542. The magnet 550 surrounds and defines a magnet opening 551. The magnet opening 551 is accessible through the top plate opening 547. The pole piece 560 is positioned interiorly of the top plate 546 and the magnet 550.

The depicted pole piece 560 is generally T-shaped in cross section and has an upper end 562, a lower end 561, a longitudinal axis A, and an overhang 563 toward the upper end 562 that extends farther radially than the remainder of the pole piece 560. A substantially straight-walled section is provided between the overhang 563 and the lower end 561. A fastener 565 extends through an opening 543 in the back plate 542 and is threadedly received in the pole piece 560 to fixedly secure the pole piece 560 in position.

A first substantially U shaped ferrous shorting bar 585A and a second substantially U shaped ferrous shorting bar 585B are positioned between the outside diameter of the top plate 546 and the back plate 542. In FIG. 7A the shorting bars 585A and 585B are shown in a first position wherein they are substantially in contact with the top plate 546 and the back plate 542. In FIG. 7B the shorting bars 585A and 585B are shown in a second position wherein they are spaced apart from the top plate 546 and the back plate 542. The shorting bars 585A and 585B may be individually adjusted to be spaced apart a larger distance from the top plate 546 and/or back plate 542 than depicted in FIG. 7B and may also be adjusted to be spaced apart a smaller distance from the top plate 546 and/or back plate 542 than depicted in FIG. 7B. The shorting bars 585A and 585B route magnetic flux away from the voice coil air gap 548 formed between the pole piece 560 and the top plate 546 of the speaker subassembly 540. When the shorting bars 585A and 585B are in the first position of FIG. 7A they route a greater amount of flux away from the voice coil air gap 548 than when they are in the second position of FIG. 7B. In other words, when the shorting bars 585A and 585B are in the first position of FIG. 7A a greater amount of magnetic flux is routed through the shorting bars 585A and 585B than when they are in the second position of FIG. 7B. Generally speaking, when the shorting bars 585A and 585B move from the first position of FIG. 7A to the second position of FIG. 7B, the amount of magnetic flux passing through the voice coil air gap 748 increases. This is akin to the pole piece 60 moving from the fourth position of FIG. 1D to the first position of FIG. 1A, wherein the amount of flux passing through the voice coil air gap 48 also increases (although it may increase by a different amount). Accordingly, generally speaking, as the shorting bars 585A and 585B are moved from the first position to the second position the average magnetic field present in the voice coil air gap 548 increases, the sound pressure level of the speaker 501 increases, and the Qes decreases.

In some embodiments a linear actuator may be coupled to each of the shorting bars 585A and 585B and may be selectively activated by a user to cause the shorting bars 585A and 585B to be repositioned. Also, for example, in some embodiments a threaded shaft may extend through each of the shorting bars 585A and 585B and threadedly engage a boss extending from the magnet 550. The threaded shaft may not engage the shorting bars 585A and 585B, allowing for rotation of the threaded shaft without rotation of the shorting bars 585A and 585B. A nut may be provided on the threaded shaft on each side of the shorting bars 585A and 585B, to thereby contact the shorting bars 585A and 585B and cause them to be repositioned radially outward or inward from top plate 546 and/or back plate 542 upon rotation of the threaded shaft. In other embodiments more or fewer shorting bars 585A and 585B may be provided. The shorting bars 585A and 585B may, in some embodiments, be removably received in openings through a structure that surrounds the top plate 546 and the back plate 542. In such embodiments none of the shorting bars 585A and 585B may be received in the openings to cause a first magnetic field to be present in the voice coil air gap 548, one of the shorting bars 585A and 585B may be received in one of the openings to cause a second magnetic field to be present in the voice coil air gap 548, and both of the shorting bars 585A and 585B may be received in the openings to cause a third magnetic field to be present in the voice coil air gap 548. Also, for example, in some embodiments alternative adjustment structure and/or methods described herein in conjunction with other embodiments of the speaker subassembly 540 may be adapted for use in adjusting the shorting bars 585A and 585B.

Figure 8A:
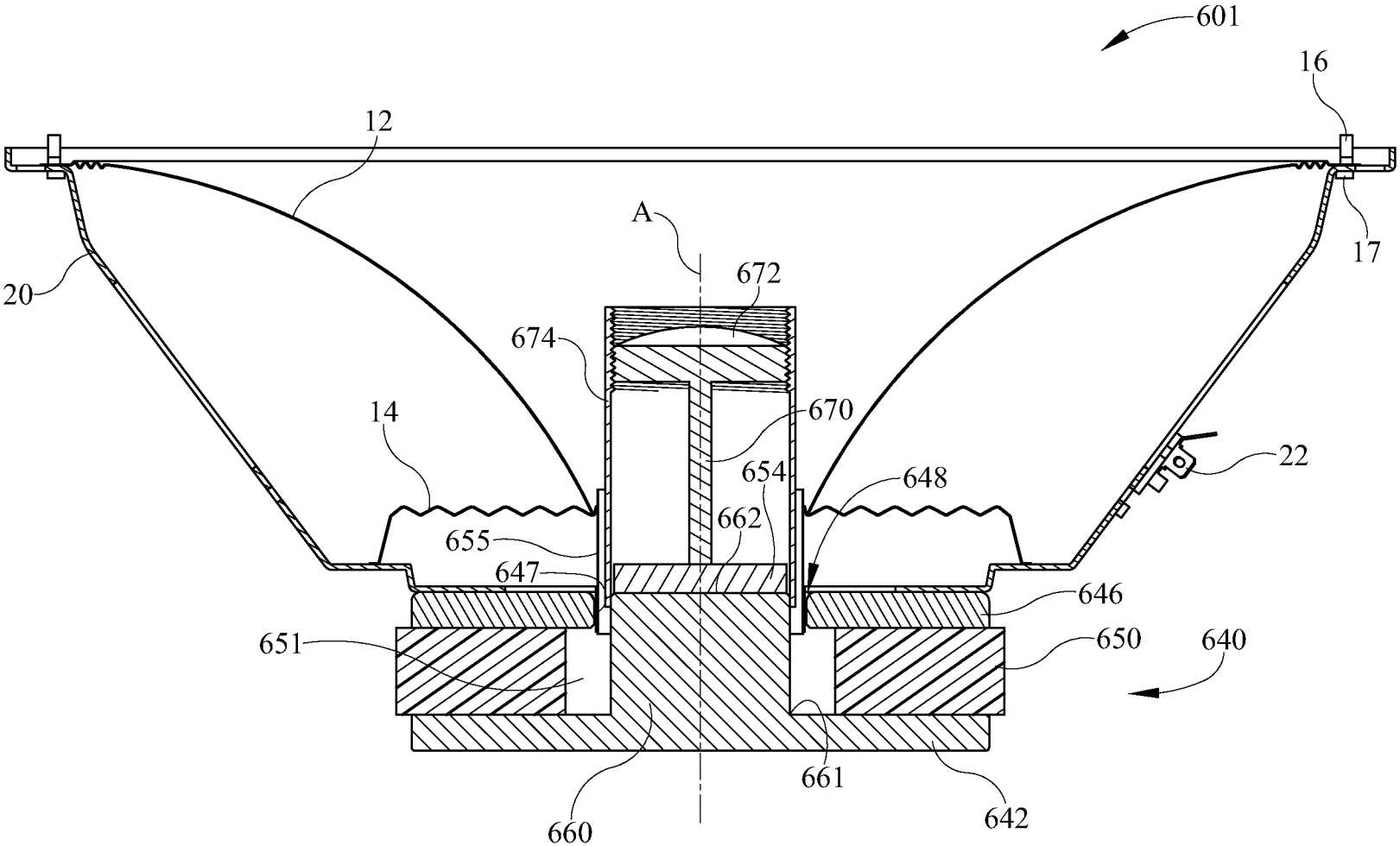
FIG. 8A illustrates a sixth embodiment of a variable flux speaker with a secondary magnet of a speaker subassembly in a first position.
Figure 8B:
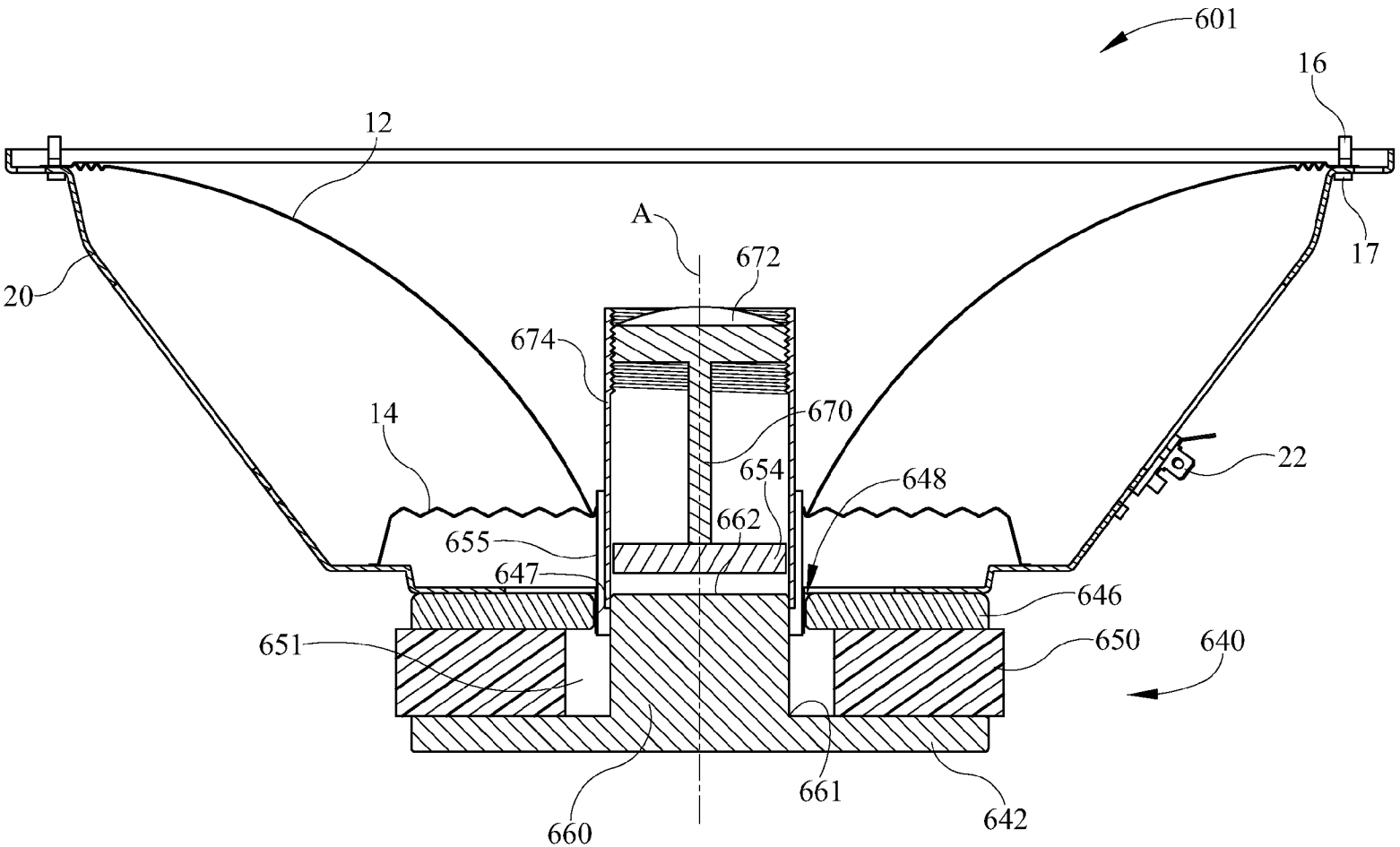
FIG. 8B illustrates the sixth embodiment of the variable flux speaker with the secondary magnet in a second position.

Referring to FIGS. 8A and 8B, a sixth embodiment of a variable flux speaker 601 is shown. The top plate 646 has a top plate opening 647 therethrough and is positioned around the voice coil structure 655 and the pole piece 660. A back plate 642 of the speaker subassembly 640 is spaced apart from the top plate 646. A magnet 650 of the speaker subassembly 640 is interposed between the top plate 646 and the back plate 642. The magnet 650 surrounds and defines a magnet opening 651. The magnet opening 651 is accessible through the top plate opening 647. The pole piece 660 is positioned interiorly of the top plate 646 and the magnet 650.

The depicted pole piece 660 has an upper end 662, a lower end 661, and a longitudinal axis A. A substantially straight-walled section is provided between the upper end 662 and the lower end 661. The depicted pole piece 660 is integrally formed with the back plate 642.

A secondary magnet 654 is positioned above the pole piece 660. The secondary magnet 654 is coupled to a shaft 670 that is coupled to a knob 672. The knob 672 is threadedly received in a non-ferrous threaded extension 674. The threaded extension 674 is coupled to the pole piece 660 and extends through a location where the dust cap 18 of the speaker would normally be placed. Rotation of the knob 672 causes the knob 672 to rotate within the threaded extension 674, thereby causing the knob 672 to move in a direction parallel with the longitudinal axis A, thereby causing the shaft 670 and the secondary magnet 654 to likewise move in a direction parallel with the longitudinal axis A. In some embodiments the shaft 670 may be immovably coupled to both the adjustment knob 672 and the secondary magnet 654, thereby causing the shaft 670 and the secondary magnet 654 to rotate as they are moved along the longitudinal axis A. In alternative embodiments the shaft 670 may be movably coupled to the adjustment knob 672 and/or the secondary magnet 654 to prevent the shaft 670 and/or the secondary magnet 654 from rotating as they are moved along the longitudinal axis A via knob 672.

In FIG. 8A the secondary magnet 654 is shown in a first position wherein it is substantially in contact with the pole piece 660. In FIG. 8B the secondary magnet 654 is shown in a second position wherein it is spaced apart from the pole piece 660. The secondary magnet 654 may be individually adjusted to be spaced apart a larger distance from the pole piece 660 than depicted in FIG. 8B and may also be adjusted to be spaced apart a smaller distance from the pole piece 660 than depicted in FIG. 8B. The secondary magnet 654 alters the magnetic field present along the voice coil air gap 648 in relation to its proximity to the voice coil air gap 648. If the secondary magnet 654 is placed in a first polar orientation it increases the magnetic field as it moves more proximal the voice coil air gap 648. If the secondary magnet 654 is placed in a second polar orientation it decreases the magnetic field as it moves more proximal the voice coil air gap 648. Accordingly, in some embodiments, when the secondary magnet 654 is in the first position of FIG. 8A a greater amount of flux is present in the voice coil air gap 648 than when the secondary magnet 654 is in the second position of FIG. 8B. Accordingly, generally speaking, in those embodiments as the secondary magnet 654 is moved from the first position to the second position the average magnetic field present in the voice coil air gap 648 decreases, the sound pressure level of the speaker 601 decreases, and the Qes increases.

One of ordinary skill in the art, having had the benefit of the present disclosure, will realize that additional or alternative structure may be used to effectuate linear displacement of the secondary magnet 654. For example, in some embodiments alternative adjustment structure and/or methods described herein in conjunction with other embodiments of the speaker subassembly 640 may be adapted for use in adjusting the secondary magnet 654. For example, in some embodiments an electronic bi-directional motor may be coupled to the 672 and may be selectively activated by a user to cause the secondary magnet 654 to be rotated and repositioned. Also, for example, in some embodiments the secondary magnet may be coupled to a linear actuator to cause the secondary magnet 654 to be repositioned. In some embodiments a controller may optionally be in electrical communication with the motor or electronic linear actuator and direct the displacement of the secondary magnet 654.

Figure 9A:
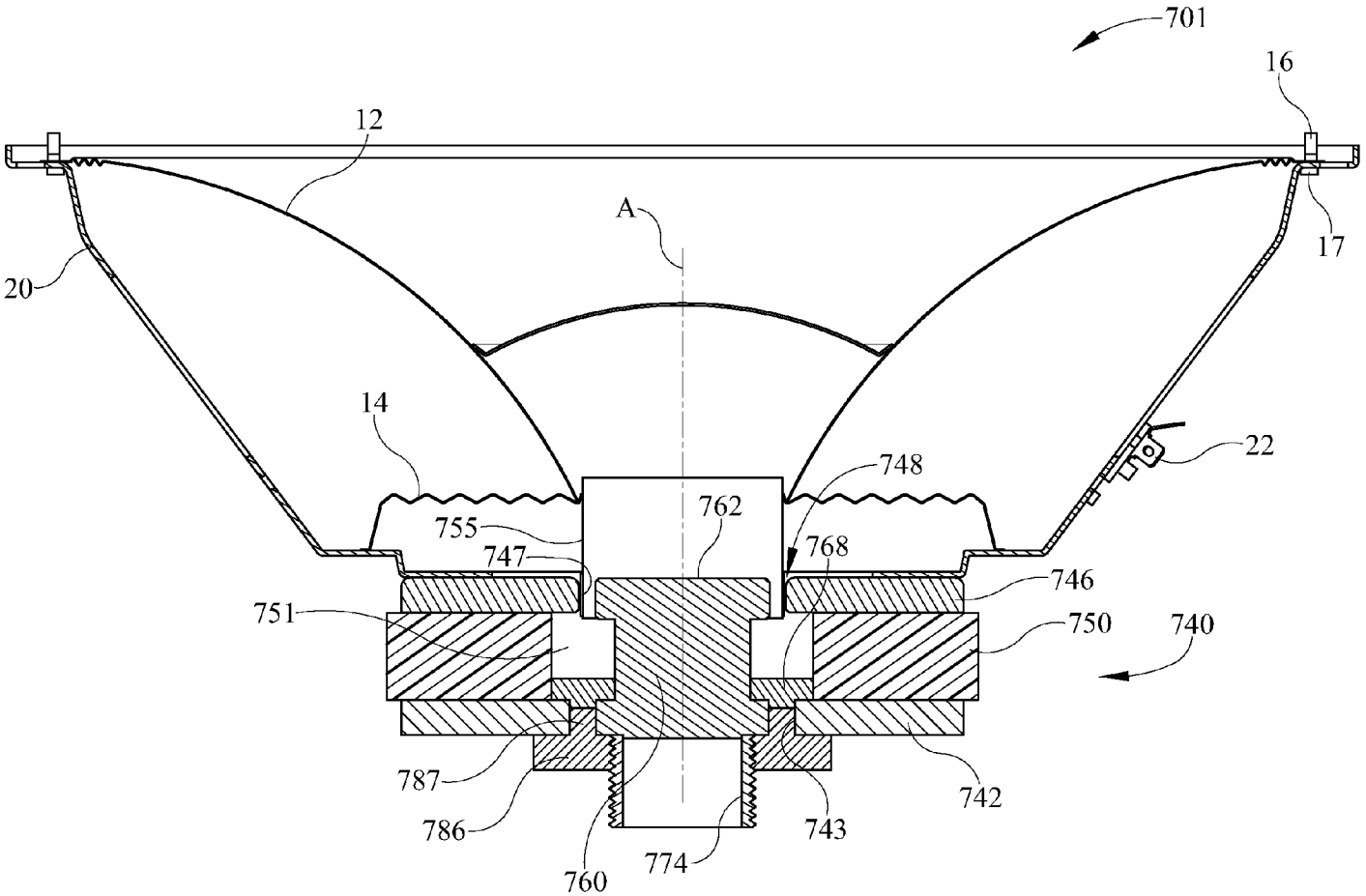
FIG. 9A illustrates a seventh embodiment of a variable flux speaker with a back plate ferrous insert ring of a speaker subassembly in a first position.
Figure 9B:
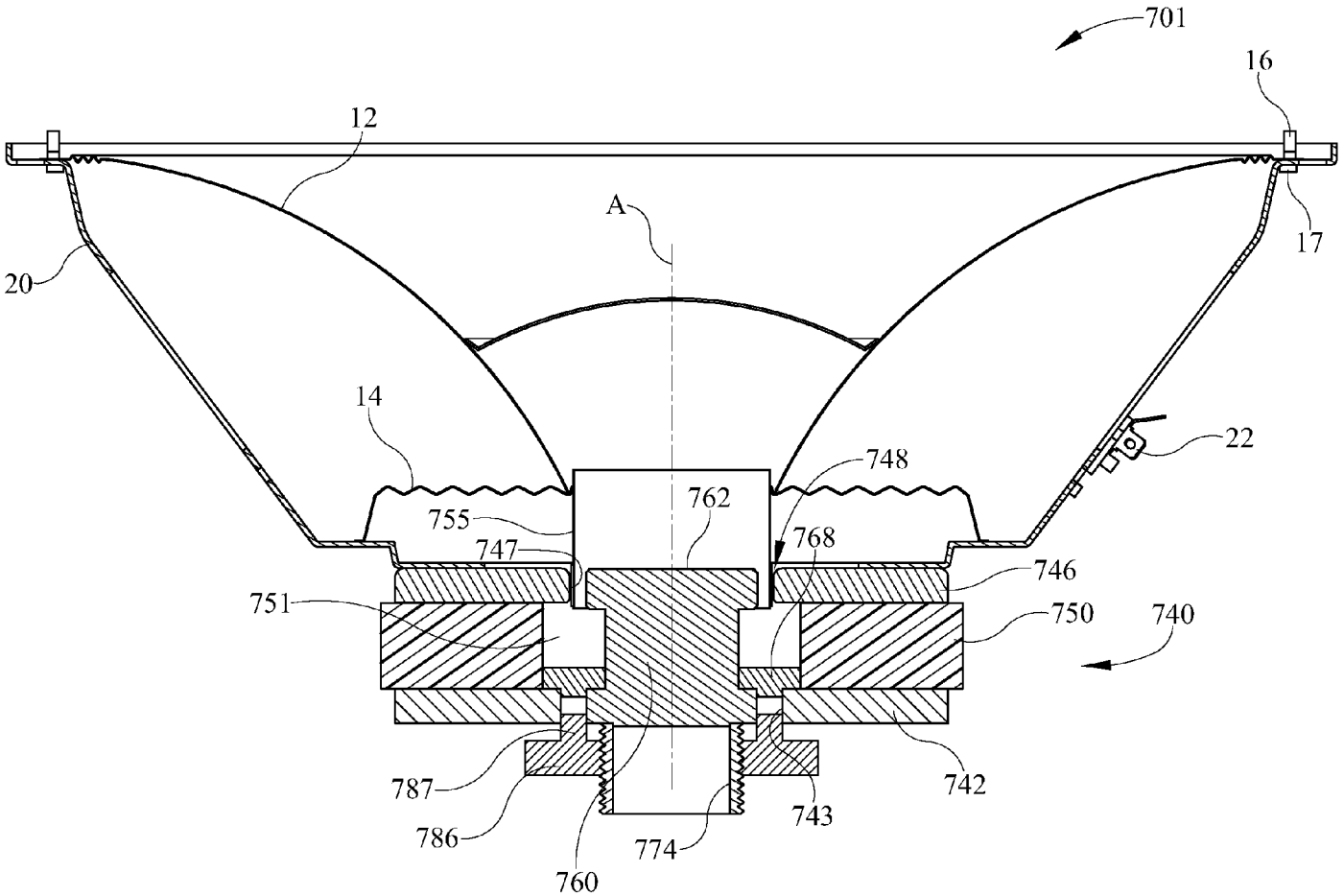
FIG. 9B illustrates the seventh embodiment of the variable flux speaker with the back plate ferrous insert ring in a second position.

Referring to FIGS. 9A and 9B, a seventh embodiment of a variable flux speaker 701 is shown. The top plate 746 has a top plate opening 747 therethrough and is positioned around the voice coil structure 755 and the pole piece 760. A back plate 742 of the speaker subassembly 740 is spaced apart from the top plate 746. A magnet 750 of the speaker subassembly 740 is interposed between the top plate 746 and the back plate 742. The magnet 750 surrounds and defines a magnet opening 751. The magnet opening 751 is accessible through the top plate opening 747. The pole piece 760 is positioned interiorly of the top plate 746 and the magnet 750.

The depicted pole piece 760 is generally I-shaped in cross-section and has an upper end 762, a lower end 761, and a longitudinal axis A. A non-ferrous alignment ring 768 extends between the pole piece 760, the magnet 750, and the back plate 742. The alignment ring 768 may be coupled to the pole piece 760 and the back plate 742 and/or the magnet 750. In some embodiments the alignment ring 768 may comprise aluminum.

The back plate 742 has an opening 743 therethough. A back plate ferrous insert ring 786 has a protrusion 787 extending therefrom that is movably received in the opening 743. The ferrous insert ring 786 is interiorly threaded about a threaded structure 774 that is coupled to the lower end 761 of the pole piece 760. Rotation of the ferrous insert ring 786 causes it to rotate about the threaded extension 774, thereby causing the ferrous insert ring 786 to move in a direction parallel with the longitudinal axis A. In FIG. 9A the ferrous insert ring 786 is shown in a first position wherein the protrusion 787 is substantially fully inserted in the back plate opening 743. In FIG. 9B the ferrous insert ring 786 is shown in a second position wherein the protrusion 787 is only approximately twenty percent received in the back plate opening 743. The ferrous insert ring 786 may be adjusted such that less of (including none of) the protrusion 787 is received in the opening 743 than depicted in FIG. 9B and may also be adjusted such that more of the protrusion 787 is received in the opening 743 than depicted in FIG. 9B.

The ferrous insert ring 786 aides in the routing of magnetic flux between the back plate 742 to the pole piece 760 by creating a ferrous path through which the magnetic field may travel. When the ferrous insert ring 786 is in the first position of FIG. 9A it enables a greater amount of magnetic flux to pass between the back plate 742 and the pole piece 760 than when it is in the second position of FIG. 9B. Accordingly, generally speaking, as the ferrous insert ring 786 is moved from the first position to the second position the amount of magnetic flux passing between the back plate 742 and the pole piece 760 decreases. Correspondingly, the average magnetic field present in the voice coil air gap 748 also decreases, the sound pressure level of the speaker 701 decreases, and the Qes increases as the ferrous insert ring 786 is moved from the first position to the second position.

One of ordinary skill in the art, having had the benefit of the present disclosure, will realize that additional or alternative structure may be used to effectuate linear displacement of the ferrous insert ring 786. For example, in some embodiments alternative adjustment structure and/or methods described herein in conjunction with other embodiments of the speaker subassembly 740 may be adapted for use in adjusting the ferrous insert ring 786. For example, in some embodiments an electronic bi-directional motor may be coupled to the ferrous insert ring 786 and may be selectively activated by a user to cause the ferrous insert ring 786 to be rotated and repositioned. Also, for example, in some embodiments the ferrous insert ring 786 may be coupled to a linear actuator to cause the ferrous insert ring 786 to be repositioned. In some embodiments a controller may optionally be in electrical communication with the motor or electronic linear actuator and direct the displacement of the ferrous insert ring 786.

Figure 10A:
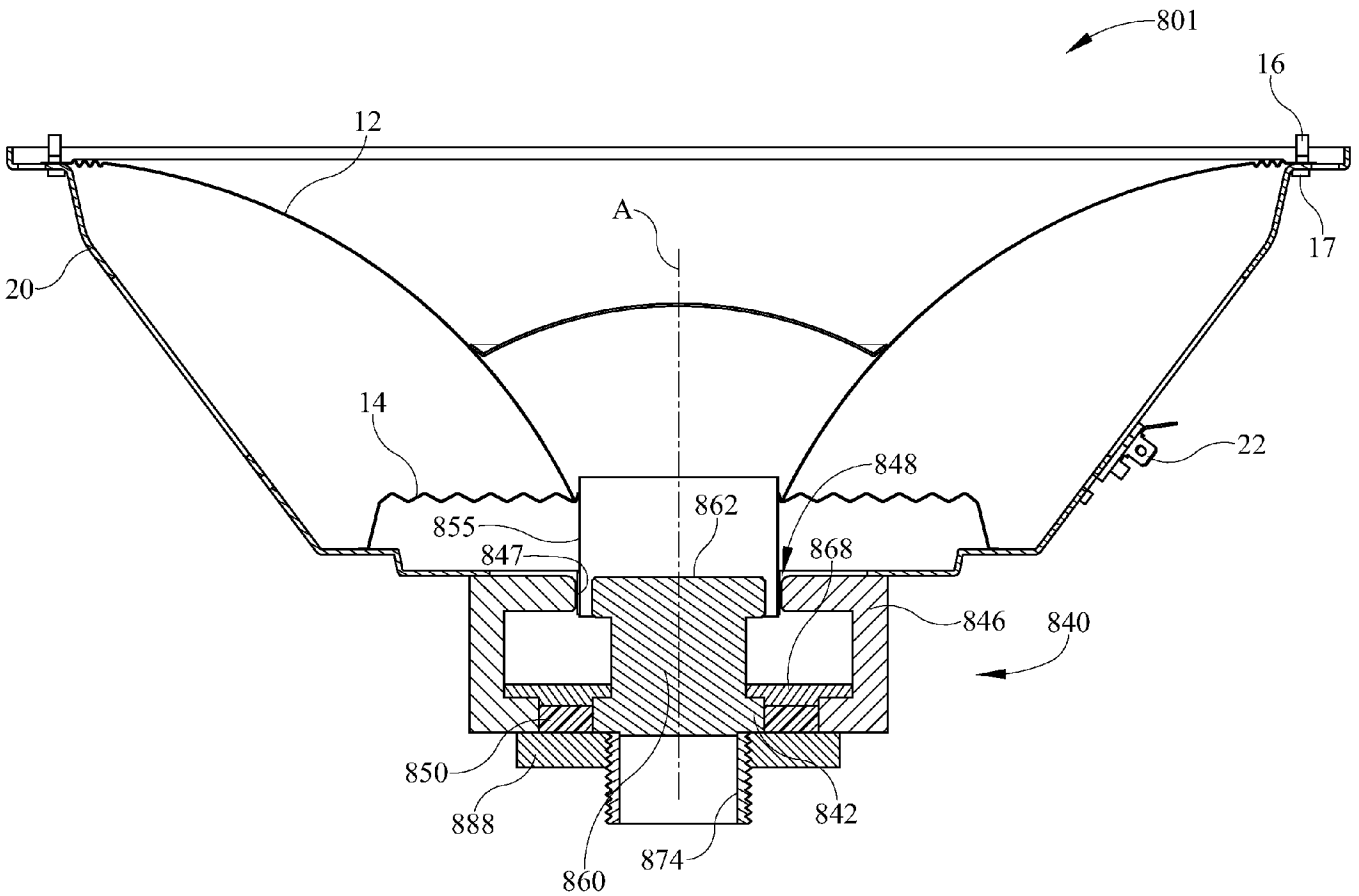
FIG. 10A illustrates an eighth embodiment of a variable flux speaker with a radially magnetized magnet of a speaker subassembly in a first position.
Figure 10B:
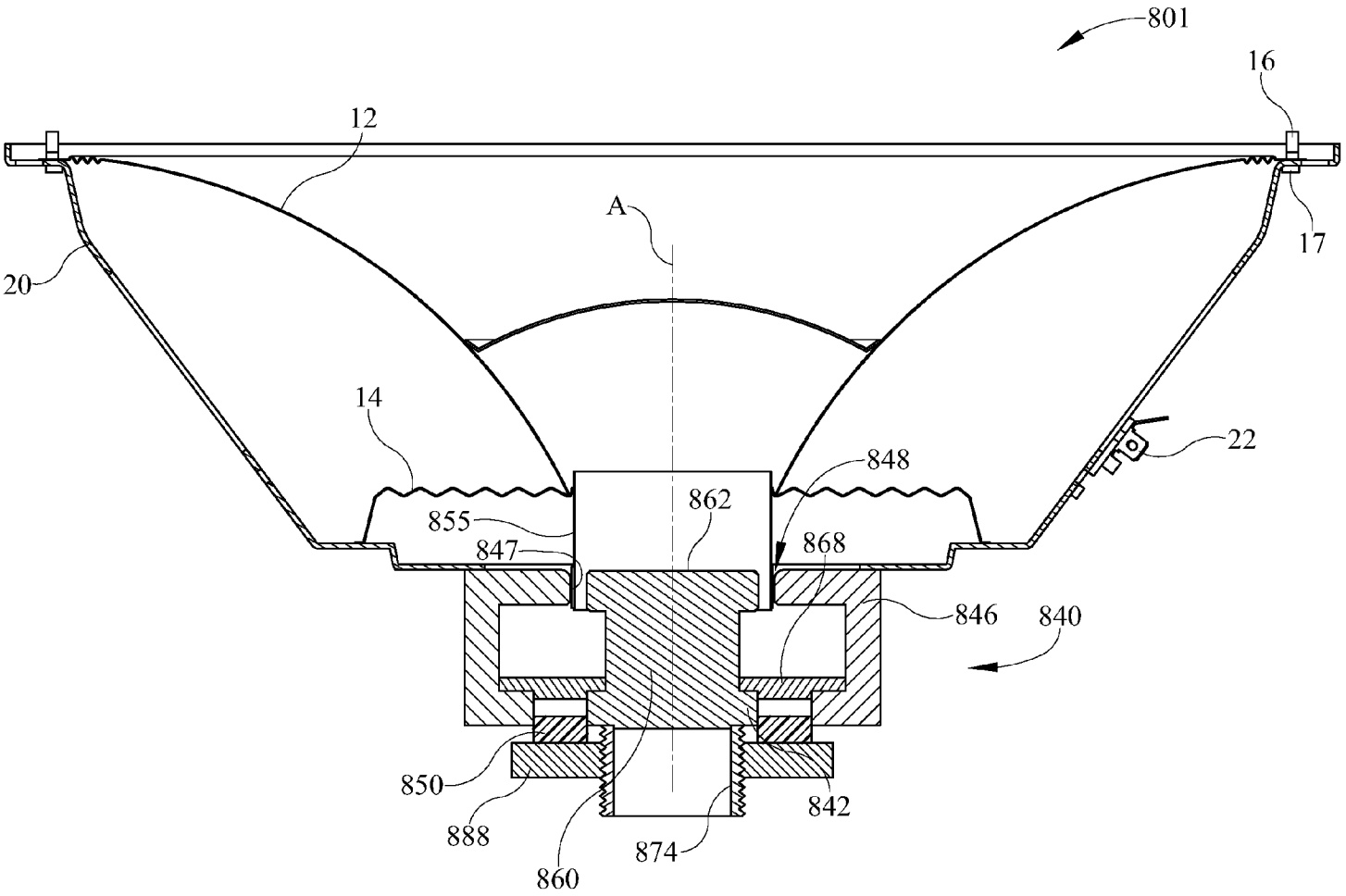
FIG. 10B illustrates the eighth embodiment of the variable flux speaker with the magnet in a second position.

Referring to FIGS. 10A and 10B, an eighth embodiment of a variable flux speaker 801 is shown. The top plate 846 has a top plate opening 847 therethrough and is positioned around the voice coil structure 855 and the pole piece 860. A back plate 842 of the speaker subassembly 840 is spaced apart from the top plate 846 and is integrally formed with the pole piece 860. A magnet 850 of the speaker subassembly 840 is interposed between the top plate 846 and the back plate 842. The magnet 850 surrounds and defines a magnet opening within which the back plate 842 is receivable. The magnet 850 is a radially magnetized magnet having a first pole adjacent the top plate 846 and a second pole adjacent the back plate 842.

The depicted pole piece 860 is generally T-shaped and has an upper end 862, a lower end 861, and a longitudinal axis A. A substantially straight-walled section is provided between the upper end 862 and the lower end 861. A non-ferrous alignment ring 868 extends between the pole piece 860, the magnet 850, and the back plate 842. The alignment ring 868 may be coupled to the pole piece 860 and the back plate 842 and/or the magnet 850. In some embodiments the alignment ring 868 may comprise aluminum.

The magnet 850 has non-ferrous adjustment structure 888 coupled thereto that is interiorly threaded about a threaded structure 874 that is coupled to the back plate 842. Rotation of the adjustment structure 888 causes it to rotate about the threaded extension 874, thereby causing the adjustment structure 888 to move in a direction parallel with the longitudinal axis A and correspondingly causing the magnet 850 to move in a direction parallel with the longitudinal axis A. In FIG. 10A the magnet 850 is shown in a first position wherein it is substantially fully inserted in between the top plate 846 and the back plate 842. In FIG. 10B the magnet 850 is shown in a second position wherein the magnet 850 is only approximately twenty percent between the top plate 846 and the back plate 842. The magnet 850 may be adjusted such that less of it (including none of it) is between the opening 843 than depicted in FIG. 10B and may also be adjusted such that more of it is between the opening 843 than depicted in FIG. 10B.

The magnet 850 creates magnetic flux between the back plate 842 and the top plate 846 (via the pole piece 860) and, resultantly, in the voice coil air gap 848 between the top plate 846 and the pole piece 860. When the magnet 850 is in the first position of FIG. 10A it creates a greater amount of magnetic flux between the back plate 842 and the top plate 846 and, resultantly, in the voice coil air gap 848 between the top plate 846 and the pole piece 860, than when it is in the second position of FIG. 10B. Accordingly, generally speaking, as the magnet 850 is moved from the first position to the second position the amount of magnetic flux passing between the back plate 842 and the top plate 846 decreases. Correspondingly, the average magnetic field present in the voice coil air gap 848 also decreases, the sound pressure level of the speaker 801 decreases, and the Qes increases.

One of ordinary skill in the art, having had the benefit of the present disclosure, will realize that additional or alternative structure may be used to effectuate linear displacement of the magnet 850. For example, in some embodiments alternative adjustment structure and/or methods described herein in conjunction with other embodiments of the speaker subassembly 840 may be adapted for use in adjusting the magnet 850. For example, in some embodiments the magnet 850 may be threaded and engage corresponding threads of the top plate 846 and/or the back plate 842. Also, for example, in some embodiments the magnet 850 may be interiorly threaded and engage threaded structure 874. Also, for example, in some embodiments an electronic bi-directional motor may be coupled to the adjustment structure 888 and may be selectively activated by a user to cause the magnet 850 to be rotated and repositioned. Also, for example, in some embodiments the magnet 850 may be coupled to a linear actuator to cause the magnet to be repositioned. In some embodiments a controller may optionally be in electrical communication with the motor or electronic linear actuator and direct the displacement of the magnet 850.

Figure 11A:
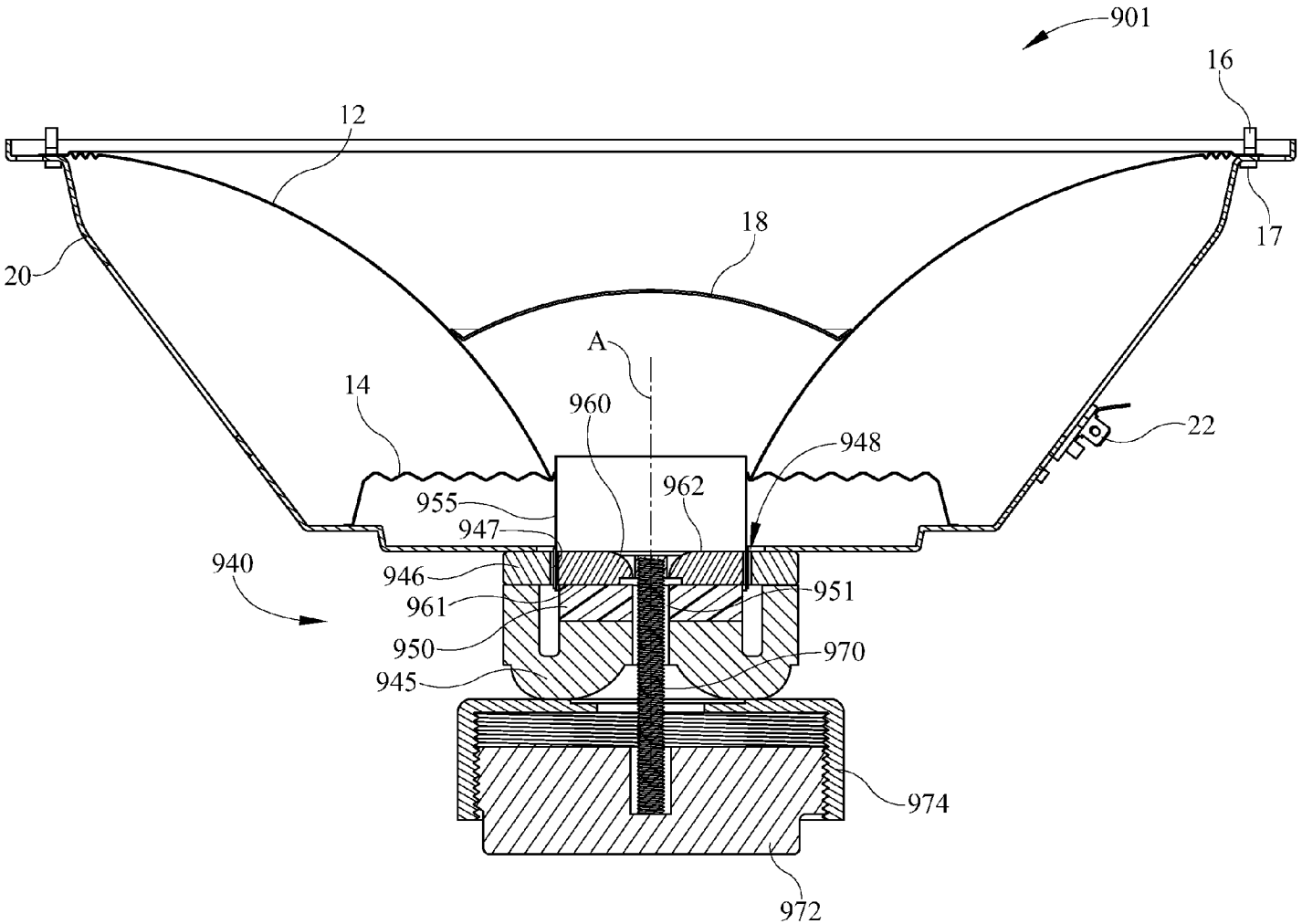
FIG. 11A illustrates a ninth embodiment of a variable flux speaker with a pole piece of the speaker subassembly in a first position.
Figure 11B:
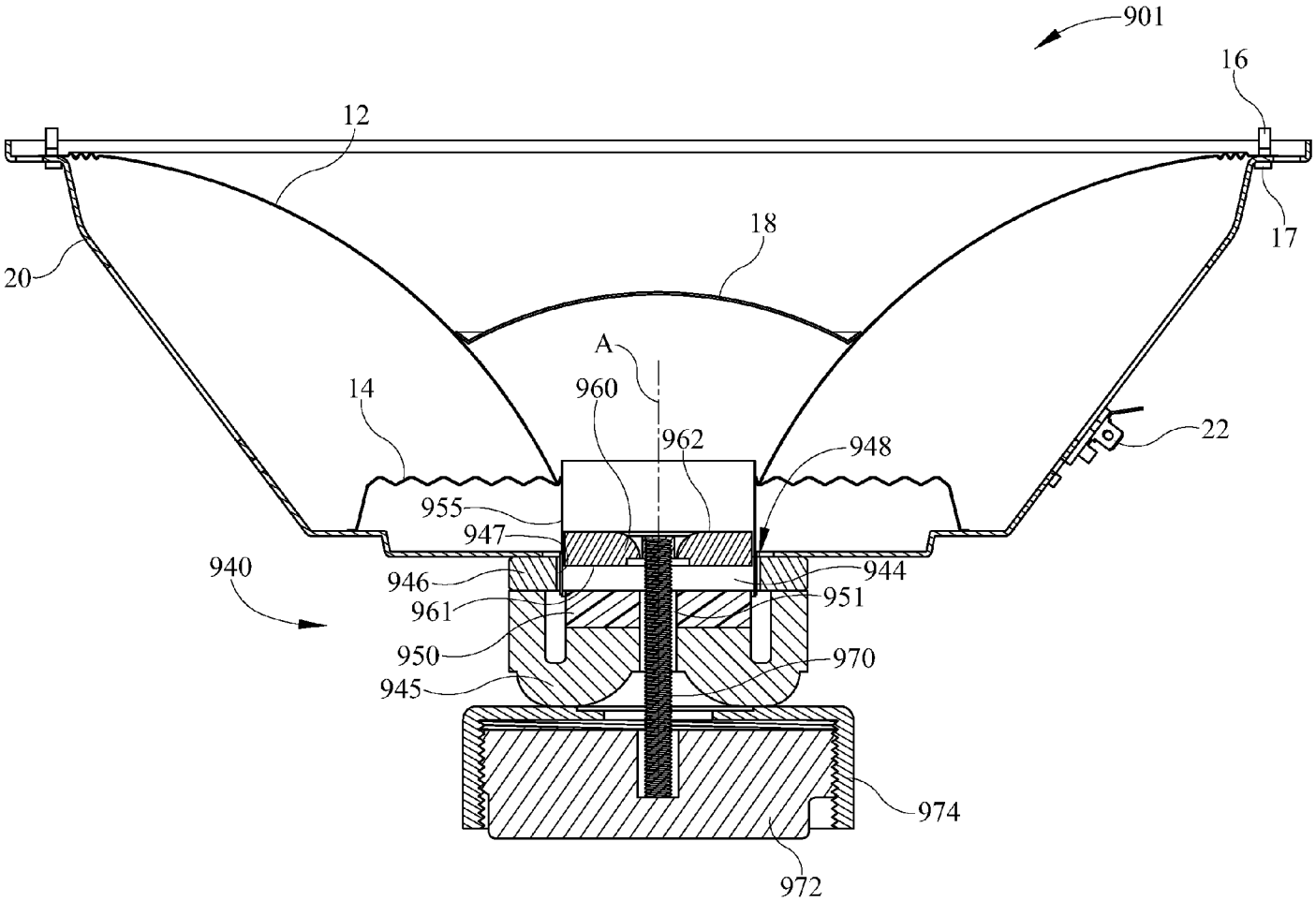
FIG. 11B illustrates the ninth embodiment of a variable flux speaker with the pole piece in a second position.

Referring to FIGS. 11A and 11B, a ninth embodiment of a variable flux speaker 901 is shown. The top plate 946 has a top plate opening 947 therethrough and is positioned around the voice coil structure 955 and the pole piece 960. The pole piece 960 is adjacent a first pole of a magnet 950 of the speaker subassembly 940. A ferrous cup yoke 945 extends from an opposite pole of the magnet 950 to the top plate 946. The magnet 950 has a magnet opening 951 therethrough. In some embodiments the magnet 950 may be a neodymium magnet. In some embodiments the magnet may be solid and not provided with a magnet opening 951 therethrough. The cup yoke 945 has an opening provided therethrough that is substantially in line with the magnet opening 951.

The depicted pole piece 960 is generally donut shaped and has an upper end 962, a lower end 961, and a longitudinal axis A extending in a direction from the lower end 961 to the upper end 961. The axis A extends through an opening that is provided through the pole piece 960 and that is substantially in line with the magnet opening 951. The magnet opening 951 and the in line openings through the pole piece 960 and the cup yoke 945 may form a cooling vent. Optionally, the pole piece 960 may be provided with a guide sleeve around at least a portion thereof and a core sleeve may telescopically receive at least a portion of the guide sleeve.

An adjustment shaft 970 extends from a coupling with the pole piece 960. The adjustment shaft 970 extends through the opening in the pole piece 960, through the magnet opening 951, and through the opening in the cup yoke 945. In other embodiments the shaft 970 may be otherwise coupled to the pole piece 960. For example, in some embodiments the shaft 970 may be integrally formed with the pole piece 960. The shaft 970 is also coupled to an adjustment knob 972. The knob 972 is threadedly received in a threaded extension 974. The threaded extension 974 is coupled to the cup yoke 945. Rotation of the knob 972 causes the knob 972 to rotate within the threaded extension 974 and move in a direction parallel with the longitudinal axis A, thereby causing the shaft 970 and pole piece 960 to likewise move in a direction parallel with the longitudinal axis A. In some embodiments the shaft 970 may be immovably coupled to both the adjustment knob 972 and the pole piece 960. In alternative embodiments the shaft 970 may be movably coupled to the adjustment knob 972 and/or the pole piece 960.

In FIG. 11A the pole piece 960 and the knob 972 are shown in a first position. In FIG. 11B the pole piece 960 and the knob 972 are shown in a second position, wherein the pole piece 960 is more distal the magnet 950 than it is in the first position. As the pole piece 960 moves from the first position to the second position a gap 944 between the pole piece 960 and the magnet 950 is created and grows larger. As the pole piece 960 moves from the first position to the second position, the magnetic field present along the voice coil air gap 948, within which the wiring of the voice coil structure 955 is suspended, becomes weaker. In alternative embodiments the cup yoke 945 may additionally or alternatively be coupled to adjustment structure and be moved generally along the axis A, thereby moving from a first position proximal the magnet 950 and top plate 946 to a second position more distal the magnet 950 and top plate 946 than the first position. Accordingly, generally speaking, as the pole piece 960 is moved from the first position to the second position the average magnetic field present in the voice coil air gap 948 decreases, the sound pressure level of the speaker 901 decreases, and the Qes increases.

One of ordinary skill in the art, having had the benefit of the present disclosure, will realize that additional or alternative structure may be used to effectuate linear displacement of the pole piece 960. For example, in some embodiments alternative adjustment structure and/or methods described herein in conjunction with other embodiments of the speaker subassembly 940 may be adapted for use in adjusting the pole piece 960. Also, for example, in some embodiments the interior diameter of the pole piece 960 may be provided with threading that engages corresponding threading of structure extending from magnet 950 or extending from the cup yoke 945.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

We claim:

1. A speaker subassembly for a speaker, said speaker subassembly comprising:

a top plate having a top plate opening therethrough;

a magnet structure in magnetic communication with said top plate, said magnet structure surrounding and defining a magnet opening;

a pole piece positioned interiorly of said top plate and said magnet, said pole piece having an upper end, a lower end more distal said top plate than said upper end, and a longitudinal axis extending from said upper end to said lower end;

a voice coil structure substantially concentrically disposed about said pole piece, said voice coil structure having a voice coil magnetic flux extending therethrough; and a secondary magnet structure in magnetic communication with said top plate;

wherein said secondary magnet structure is repositionable from at least a first fixed position to at least a second fixed position;

wherein in said first fixed position of said secondary magnet structure said voice coil magnetic flux is greater than in said second fixed position of said secondary magnet structure.

2. The speaker subassembly of claim 1 further comprising an adjustment structure coupled to said secondary magnet structure.

3. The speaker subassembly of claim 2 wherein said adjustment structure is concentrically aligned with said longitudinal axis.

4. The speaker subassembly of claim 3 further comprising a threaded extension threadedly engaging said adjustment structure.

5. The speaker subassembly of claim 1 wherein said secondary magnet structure is positioned directly atop said pole piece in one of said first fixed position and said second fixed position.

6. The speaker subassembly of claim 1 wherein said secondary magnet structure is coupled to a shaft extending substantially parallel to said longitudinal axis.

7. A speaker subassembly for a variable flux speaker, said speaker subassembly comprising:

a voice coil structure disposed about and movable along a longitudinal axis, said voice coil structure having a voice coil magnetic flux extending therethrough;

a repositionable magnet structure in magnetic communication with said voice coil structure;

wherein said magnet structure is repositionable from at least a first fixed position to at least a second fixed position;

wherein said voice coil magnetic flux is dependent on position of said magnet structure; and wherein in said first fixed position of said magnet structure said voice coil magnetic flux is greater than in said second fixed position of said magnet structure.

8. The speaker subassembly of claim 7 further comprising an adjustment structure coupled to said magnet structure.

9. The speaker subassembly of claim 8 wherein said adjustment structure is concentrically aligned with said magnet structure.

10. The speaker subassembly of claim 8 further comprising a threaded extension threadedly engaging said adjustment structure.

11. The speaker subassembly of claim 7 further comprising a pole piece concentrically aligned with said magnet structure.

12. The speaker subassembly of claim 11, wherein said magnet structure is positioned directly atop said pole piece in one of said first fixed position and said second fixed position.

13. The speaker subassembly of claim 11 wherein said magnet structure surrounds said pole piece.

14. The speaker subassembly of claim 7 wherein said magnet structure is coupled to a shaft extending substantially parallel to said longitudinal axis.

15. The speaker subassembly of claim 14 wherein said shaft is coupled to an adjustment knob.

16. The speaker subassembly of claim 15 wherein at least a portion of said adjustment knob is threaded.

17. A method of selectively adjusting magnetic flux through a voice coil structure of a loudspeaker, the method comprising:

repositioning a magnet structure of said loudspeaker, said magnet structure in magnetic communication with a voice coil structure of said loudspeaker, said voice coil structure having a voice coil magnetic flux extending therethrough that is dependent on positioning of said magnet structure;

wherein said magnet structure is repositionable from at least a first fixed position to a second fixed position; and wherein in said first fixed position of said secondary magnet structure said voice coil magnetic flux is greater than in said second fixed position of said secondary magnet structure.

18. The method of claim 17 wherein said magnet structure is positioned atop a pole piece of said loudspeaker in one of said first fixed position and said second fixed position.

19. The method of claim 17 wherein said magnet structure is also repositionable to at least a third fixed position between said first fixed position and said second fixed position.

20. The method of claim 18 wherein said magnet structure is provided peripherally of said voice coil structure.

* * * * *